US006957031B2

(12) United States Patent
Tomita et al.

(10) Patent No.: US 6,957,031 B2
(45) Date of Patent: Oct. 18, 2005

(54) IMAGE ADJUSTING METHOD, IMAGE FORMING APPARATUS AND MEMORY PRODUCT

(75) Inventors: Norio Tomita, Yamatokoriyama (JP); Yoshikazu Harada, Nara (JP); Kyosuke Taka, Nara (JP); Toshio Yamanaka, Yao (JP); Nobuo Manabe, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 57 days.

(21) Appl. No.: 10/778,384

(22) Filed: Feb. 13, 2004

(65) Prior Publication Data

US 2004/0161268 A1 Aug. 19, 2004

(30) Foreign Application Priority Data

Feb. 14, 2003 (JP) ..... 2003-037363

(51) Int. Cl.[7] ..... G03G 15/01
(52) U.S. Cl. ..... 399/301
(58) Field of Search ..... 399/297, 298, 399/299, 301, 302; 347/116

(56) References Cited

U.S. PATENT DOCUMENTS 6,148,168 A 11/2000 Hirai et al. ..... 399/301
6,188,861 B1 * 2/2001 Parker et al. ..... 399/299
6,618,064 B2 * 9/2003 Takahashi et al. ..... 347/116
6,701,117 B2 * 3/2004 Kaji ..... 399/301
6,885,841 B2 * 4/2005 Harada et al. ..... 399/301

FOREIGN PATENT DOCUMENTS

JP 10-213940 8/1998
JP 2000-035704 2/2000
JP 2000-081744 3/2000

* cited by examiner

*Primary Examiner*—Hoang Ngo
(74) *Attorney, Agent, or Firm*—David G. Conlin; David A. Tucker; Edwards & Angell, LLP

(57) ABSTRACT

An average concentration value is detected within a measurement area (about 10 dots) corresponding to the pitch of a detection pattern in the total color matching adjustment range (100 dots), and from a value detected as a local maximum value, a candidate for correction value for the exposure timing of an adjustment image is acquired within the color matching adjustment range. This process is carried out for two types of detection patterns having different pitches thereby to acquire two candidates. A correction value for the exposure timing is determined from a candidate shared by the two detection patterns. At the time of color matching adjustment, the wasteful consumption of the developer or the like is suppressed, while carrying out the color matching adjustment efficiently within a short time.

10 Claims, 22 Drawing Sheets

FIG. 9

| d | CANDIDATES FOR CORRECTION VALUE | | | | | | | | | | |
|---|---|---|---|---|---|---|---|---|---|---|---|
| 11 | | 10 | 21 | 32 | 43 | 54 | 65 | 76 | 87 | 98 | |
| 9 | 2 | 11 | 20 | 29 | 38 | 47 | 56 | 65 | 74 | 83 | 92 |

FIG. 13A

DETECTION RANGE=0-100 DOTS

| d | CANDIDATES FOR CORRECTION VALUE | | | | | | | | | | | |
|---|---|---|---|---|---|---|---|---|---|---|---|---|
| 12 | 5 | 17 | 29 | 41 | 53 | 65 | 77 | 89 | | | | |
| 11 | 10 | 21 | 32 | 43 | 54 | 65 | 76 | 87 | 98 | | | |
| 10 | 5 | 15 | 25 | 35 | 45 | 55 | 65 | 75 | 85 | 95 | | |
| 9 | 2 | 11 | 20 | 29 | 38 | 47 | 56 | 65 | 74 | 83 | 92 | |
| 8 | 1 | 9 | 17 | 25 | 33 | 41 | 49 | 57 | 65 | 73 | 81 | 89 | 97 |

FIG. 13B

DETECTION RANGE=0-20 DOTS

| d | CANDIDATES FOR CORRECTION VALUE | | | | | |
|---|---|---|---|---|---|---|
| 4 | 2 | 6 | 10 | 14 | 18 | MEASUREMENT AREA 9-12 |
| 5 | 4 | 9 | 14 | 19 | | MEASUREMENT AREA 8-12 |

IMAGE ADJUSTING METHOD, IMAGE FORMING APPARATUS AND MEMORY PRODUCT

This Nonprovisional application claims priority under 35 U.S.C. §119(a) on Patent Application No. 2003-037363 filed in Japan on Feb. 14, 2003, the entire contents of which are hereby incorporated by reference.

BACKGROUND OF THE INVENTION

The present invention relates to an image adjusting method by an electrophotographic system and an image forming apparatus and a memory product for recording a computer program to implement the image forming apparatus, more particularly, to an image adjusting method and an image forming apparatus for adjusting color misregistration of a multicolor image occurring at the time of forming the multicolor image by superposing a plurality of color component images, and to a memory product for recording a computer program to implement the image forming apparatus.

In image forming apparatuses such as a digital color copier and a digital color printer, an input image data is decomposed into color components and processed, after which the images of the color components are superposed to form a multicolor image. In forming a multicolor image, a failure in accurately superposing the images of the color components causes a color misregistration of the multicolor image formed, thus deteriorating image quality. Especially in an image forming apparatus having an image forming unit for each color component to improve the speed of forming a multicolor image, an image of each color component is formed in each image forming unit, and the images of the respective color components are sequentially superposed thereby to form a multicolor image. This image forming apparatus poses the serious problem that the transfer position of the image of each color component is liable to deviate which causes a color misregistration of the multicolor image.

In view of this, an image forming apparatus has been proposed in which in order to superpose the images of the color components accurately, the color matching adjustment is conducted for correcting the color misregistration of the multicolor image thereby to form a satisfactory multicolor image free of a color misregistration. In the color matching adjustment, the displacement of an image forming position of a given color component with respect to an image forming position of a reference color component is detected by an optical sensor. Based on the result of this detection, an adjusting value for the image forming position is calculated, and in accordance with this adjusting value, the timing of forming an image of each color component is adjusted in such a manner as to assure coincidence of the transfer positions of the images of the respective color components. In order to calculate the adjusting value, the image of each color component is transferred at the same timing and the distance between the transfer positions of the respective color components is detected or the concentration of the multicolor image with the color components superposed is measured.

In an image forming apparatus for detecting the distance between the transfer positions of the images of the respective color components and correcting the color misregistration based on the amount of displacement of the detected transfer positions, for example, the distance between the image formed of a reference color component and the image formed of other color components is detected by a detector, and based on the detected distance, the amount of displacement of the transfer position of each color component is determined thereby to correct the color misregistration (Japanese Patent Application Laid-Open No. 10-213940 (1998)).

Also, an image forming apparatus has been proposed, in which the concentration of a multicolor image with images of the color components superposed is measured, and the color misregistration is corrected in such a manner that the concentration measurement represents a concentration with the images of the color components accurately superposed (Japanese Patent Application Laid-Open No. 2000-81744). With this image forming apparatus, in order to improve the correction accuracy, the image of each color component of the same shape is repeatedly formed. As an image of the same shape, a plurality of line segment images (line images) are formed and the concentration of a multicolor line image is detected by a detector thereby to determine the superposed state of the line images of the color components. A state in which the concentration of the multicolor line image detected by the detector is in a predetermined concentration range is regarded as a state in which the line images of the color components are accurately superposed one on another. The color misregistration is corrected and the color matching adjustment is conducted in such a manner as to form an image in this superposed state.

However, in the image forming apparatus for determining the transfer position of each image using a detector for detecting the transfer position of the image of each color component, the detection of a minor displacement of the transfer position requires a detector of high detection accuracy.

The conventional image forming apparatus for color matching adjustment using the line images described above, on the other hand, requires the operation to determine a correction value at which a reference color component image (reference image) and a color component image to be adjusted (adjustment image) are superposed completely one on the other, while shifting the adjusting value for each line over the entire area of color matching adjustment. This poses the problem that the concentration is required to be detected for correcting the color misregistration over the entire area in the range where the color matching adjustment is possible, thereby consuming a long time for color matching adjustment, and in the case where the adjustment time is to be reduced, a sufficiently wide area for color matching adjustment cannot be secured.

Further, the method in which the superposition of the reference image and the adjustment image is detected by the image concentration in the particular image forming area poses the problem that a plurality of reference images and adjustment images are required to be formed to assure stable detection, thereby increasing the amount of the developer consumed while at the same time lengthening the time required for color matching adjustment.

SUMMARY OF THE INVENTION

In view of this situation, the present invention has been developed, and the object of the invention is to provide an image adjusting method, an image forming apparatus and a memory product in which the superposed state is detected for two sets of reference images and correction images while changing the adjusting value for the image forming position within a predetermined range, a candidate for adjusting value to assure the superposition of the two images of each set is acquired from the detection result of the particular set, and the adjusting value is acquired from the candidate obtained for each set of the images, so that the color matching adjustment can be carried out without expanding the adjustment range with a smaller amount of developer and a shorter adjustment time.

According to a first aspect of the invention, there is provided an image adjusting method for adjusting the image forming position of each color component image so that a plurality of color component images are superposed, comprising:

a first step of forming a reference image of one color component;

a second step of forming an adjustment image of other color component on the reference image in accordance with an adjusting value for a predetermined image forming position;

a third step of detecting a superposed state of the reference image and the adjustment image thus formed;

a fourth step of repeating the process of the first to third steps while changing the adjusting value sequentially within a predetermined range;

a fifth step of acquiring a first candidate for the adjusting value for the image forming position where the two images are superposed, based on the result of detection in the third step;

a sixth step of acquiring a second candidate for the adjusting value for the image forming position where the two images are superposed, after executing the process of the first to fourth steps, using a reference image and an adjustment image different from the aforementioned reference image and the aforementioned adjustment image; and a seventh step of acquiring an adjusting value for the image forming position of the adjustment image based on the first and second candidates thus acquired.

In this aspect of the invention, two sets of reference images and adjustment images having different pitches, for example, are used to detect the superposed state, and based on the result of detection, a candidate for adjusting value to assure the superposition of the two images is acquired from each set of images, and an adjusting value is determined from the candidate thus acquired. In this way, two types of adjustment images having different pitches are used to obtain an adjusting value in such a manner that the two images are superposed. As compared with the color matching adjustment using a reference image and one adjustment image, therefore, the color matching adjustment in an image forming area with higher accuracy is made possible. Also, in the case where a reference image and an adjustment image with an image forming position having a periodicity are used, a candidate not included in a comparatively narrow range can be predicted from a candidate acquired from the particular range. Thus, the time required for the color matching adjustment is shortened while at the same time reducing the required amount of the developer.

In the image adjusting method according to this invention, the reference images and the adjustment images are both an image having a predetermined shape, and the interval between the adjustment images for acquiring the first candidate is differentiated from the interval between the adjustment images for acquiring the second candidate to form an adjustment image on a reference image. According to this invention, two sets of reference images and adjustment images having different pitches are used for color matching adjustment. Since an adjusting value is acquired using two types of adjustment images having different pitches in such a manner that the two images are superposed one on the other, the color matching adjustment in an image forming area with higher accuracy is made possible than the color matching adjustment using a reference image and one adjustment image.

According to another aspect of the invention, there is provided an image forming apparatus for forming an image by superposing a plurality of color component images, comprising:

means for forming a reference image of a color component;

means for storing an adjusting value for an image forming position;

means for changing the adjusting value thus stored;

means for forming an adjustment image of other color component on the reference image in accordance with the adjusting value sequentially changed within a predetermined range;

means for detecting a superposed state of the reference image and the adjustment image thus formed; and means for acquiring, based on the result of detection by the detection means, a plurality of candidates for the adjusting values for an image forming position where the two images are superposed;

wherein two candidates for adjusting value are acquired using two sets of different reference images and adjustment images, and an adjusting value is determined from the two candidates thus acquired.

In this aspect of the invention, a superposed state is detected using two sets of reference images and adjustment images having different pitches, for example, and an adjusting value is determined in such a manner that one candidate for adjusting value acquired by the color matching adjustment with one pitch coincides with another candidate for adjusting value acquired by the color matching adjustment with the other pitch. Since two sets of reference images and adjustment images of different pitches are used to determine an optimum adjusting value, an adjusting value can be determined at which all the reference images and the adjustment images in the image forming area are superposed accurately, thereby ensuring a highly accurate color matching adjustment. Also, in the case where reference images and adjustment images with periodic image forming positions are used, a candidate not included in a comparatively narrow range can be predicted from the candidate for the adjusting value acquired from the particular range. Therefore, the time required for color matching adjustment is shortened while at the same time reducing the amount of the developer.

With an image forming apparatus according to this invention, the detection means is for measuring the concentration of the image forming area. According to this invention, the reference image and the adjustment image are formed while sequentially shifting the adjustment image forming position of the adjustment image with reference to the reference image, and the color matching adjustment is carried out by detecting the concentration in the image forming area. In the case where the detected concentration assumes a local maximum value, for example, it is determined that the two images are superposed, and the adjusting value associated with this superposition is used as one of the candidates to be acquired.

The image forming apparatus according to this invention, in which the reference image and the adjustment image of each image set has a predetermined shape, further comprises means for storing the interval of forming the adjustment images of the respective image sets, and in accordance with the image forming interval stored in the storage means, an adjustment image is formed. According to this invention, the color matching adjustment is carried out using two sets of reference images and adjustment images having different pitches, and an adjusting value is determined in such a manner as to assure the superposition of the two images using two types of adjustment images having different pitches. As compared with the color matching adjustment using a reference image and one adjustment image, therefore, the accuracy of the color matching adjustment in the image forming area is improved.

With an image forming apparatus according to this invention, the candidate for an adjusting value to be acquired is an adjusting value corresponding to a position spaced by an integer multiple of the image forming interval from the image forming position of the adjustment image with the two images superposed. According to this invention, the position spaced by an integer multiple of the image forming interval from the position where the two images are superposed is acquired as a candidate for adjusting value. Therefore, another candidate can be easily acquired by arithmetic operation from a candidate for adjusting value acquired in the detection area.

An image forming apparatus according to this invention further comprises means for receiving an instruction to omit the detection of the superposed state using one of the two sets of the reference images and the adjustment images, wherein upon receipt of the instruction, the particular reference image and the particular adjustment image stop being formed. According to this invention, the detection of the superposed state using one of the two sets of the reference images and the adjustment images is omitted. In the case where the color matching adjustment is carried out before forming an image after switching on power of the image forming apparatus, therefore, no occurrence of large color misregistration can be predicted upon lapse of a predetermined length of time after power is switched on or upon formation of an excessive number of images. Thus, the color matching adjustment may be carried out only for one of the two sets of the reference images and the adjustment images, while omitting the color matching adjustment for the other image set. By omitting the color matching adjustment for one of the two image sets in this way, both the amount of the developer consumed and the time required for adjustment are reduced.

An image forming apparatus according to this invention further comprises means for judging, upon detection of the superposed state of an adjustment image and a reference image of one color component, whether the superposed state of an adjustment image and a reference image of other color component is to be detected or not, wherein upon judgement that such detection is required, the adjustment image is formed on the reference image. According to this invention, in the case where an adjustment image and a reference image of one color component are superposed, it is judged whether the superposed state of an adjustment image of other color component is to be detected or not, and only upon judgement that the detection is required, the particular adjustment image is formed. In place of the adjustment image of the color component of which the superposed state with a reference image is detected, therefore, an adjustment image of other color component is formed. Thus, the time length required for adjustment of each color component image is shortened. Also, the elimination of the adjustment image of a specific color component reduces the amount of the developer for the particular color component.

An image forming apparatus according to this invention further comprises means for suspending the formation of a new reference image and a new adjustment image upon detection of the superposed stage of the adjustment images of all the color components to be detected. According to this invention, in the case where the superposed state of the adjustment images of all the component colors is obtained, the formation of the image of the reference color component is suspended. Therefore, the amount of the developer is reduced while shortening the adjustment time.

According to still another aspect of the invention, there is provided a memory product for recording a computer program for causing a computer to adjust the image forming position of each color component image so that a plurality of color component images are superposed, the computer program comprising a first step of causing the computer to form a reference image of one color component, a second step of causing the computer to form an adjustment image of other color component on the reference image in accordance with an adjusting value for a predetermined image forming position, a third step of causing the computer to detect a superposed state of the reference image and the adjustment image thus formed, a fourth step of causing the computer to repeat the process of the first to third steps while changing the adjusting value sequentially within a predetermined range, a fifth step of causing the computer to acquire a first candidate for the adjusting value for the image forming position where the two images are superposed, based on the result of detection in the third step, a sixth step of causing the computer to acquire a second candidate for the adjusting value for the image forming position where the two images are superposed, after executing the process of the first to fourth steps using a different reference image and a different adjustment image, and a seventh step of causing the computer to determine an adjusting value for the image forming position of the adjustment image based on the first and second candidates thus acquired.

According to this invention, the superposed state is detected by use of two sets of reference images and adjustment images having different pitches, and based on the detection result, candidates for adjusting values are acquired from each set in such a manner that the two images are superposed. The adjusting value is determined from the candidates thus acquired. In this way, an adjusting value is obtained at which the two images are superposed using two types of adjustment images having different pitches, and therefore as compared with a case in which the color matching adjustment is carried out using a reference image and one adjustment image, a highly accurate color matching adjustment is made possible in the image forming area. In the case where a reference image and an adjustment image having a periodic image forming position are used, on the other hand, a candidate outside a comparatively narrow range can be predicted on the basis of the candidates acquired in the particular range. Therefore, the time length required for color matching adjustment can be shortened while reducing the amount of the developer.

The above and further objects and features of the invention will more fully be apparent from the following detailed description with accompanying drawings.

BRIEF DESCRIPTION OF THE DRAWINGS

FIG. 9 is a diagram showing a list of candidates for correction value acquired from each detection pattern.

FIGS. 13A and 13B are diagrams for explaining the relation between the pitch of a detection pattern and a candidate for correction value found in a predetermined color matching adjustment range.

DETAILED DESCRIPTION OF THE INVENTION

The present invention is explained below specifically with reference to the drawings showing embodiments thereof.

(First Embodiment)

Figure 1:
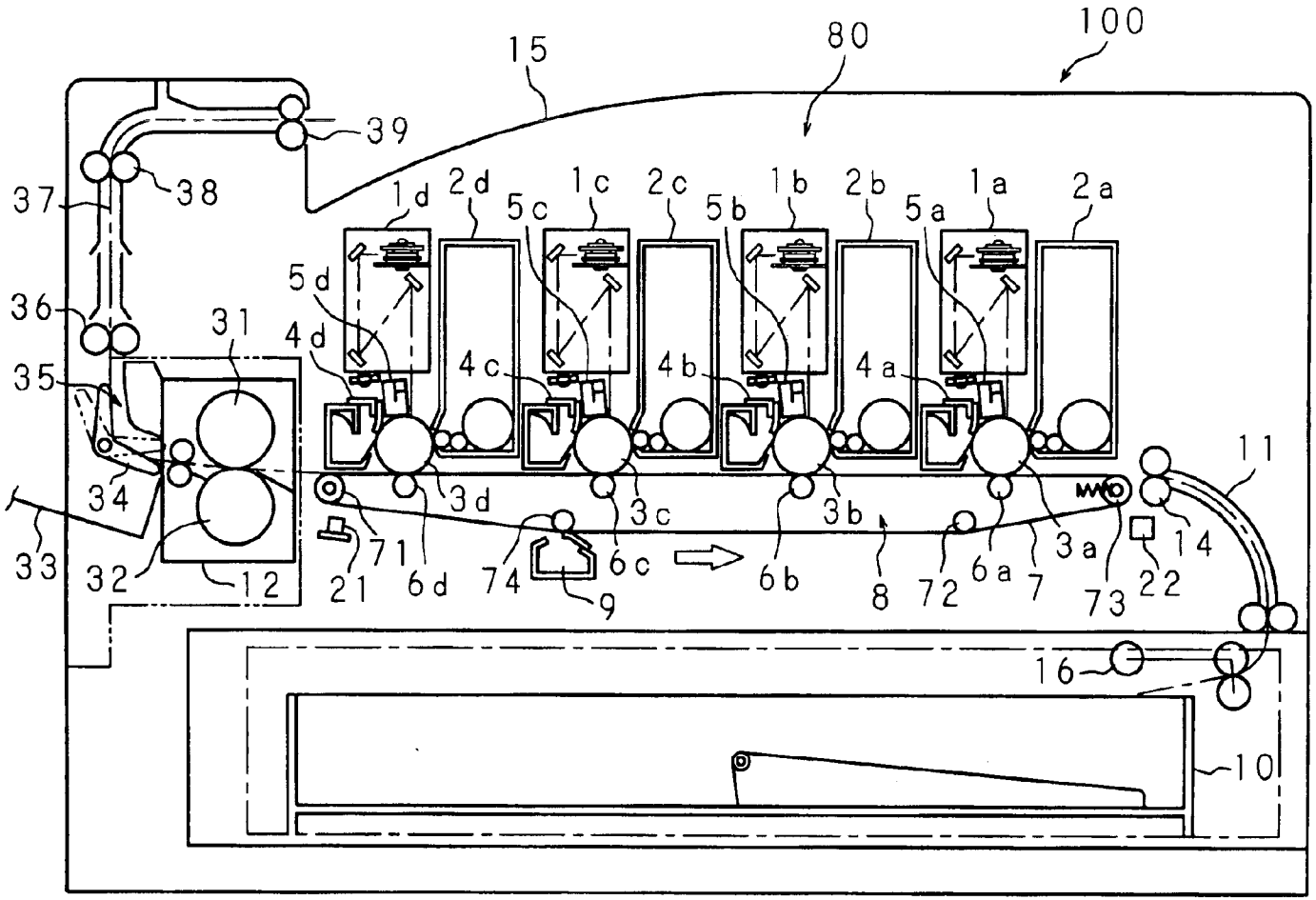
FIG. 1 is a sectional view showing a general configuration of an image forming apparatus according to this invention.

FIG. 1 is a sectional view showing a general configuration of an image forming apparatus according to this invention. In FIG. 1, reference numeral 100 designates an image forming apparatus according to this invention, which is specifically a digital color printer, a digital color copier or a composite machine. The image forming apparatus 100, as shown in FIG. 1, comprises an image forming station 80, a transfer conveying belt unit 8, a registration detecting sensor 21 and a temperature/humidity sensor 22.

The image forming station 80 of the image forming apparatus 100, in order to form a multicolor image using black (K), cyan (C), magenta (M) and yellow (Y), includes exposure units 1*a*, 1*b*, 1*c*, 1*d* for forming four types of latent images of the respective colors, developing units 2*a*, 2*b*, 2*c*, 2*d* for developing the latent images of the respective colors, photosensitive drums 3*a*, 3*b*, 3*c*, 3*d*, cleaner units 4*a*, 4*b*, 4*c*, 4*d*, and charging units 5*a*, 5*b*, 5*c*, 5*d*, as shown in FIG. 1. The symbols a, b, c, d attached to the reference numerals designate the colors black (K), cyan (C), magenta (M) and yellow (Y), respectively.

In the description that follows, except for explaining a specific part of a specific color, the component parts for each color are collectively referred to as an exposure unit 1, a developing unit 2, a photosensitive drum 3, a cleaner unit 4 and a charging unit 5.

The exposure unit 1 is a laser scanning unit (LSU) including a write head or a laser radiation unit having an array of light-emitting devices such as EL (elector luminescence) or LED (light-emitting diode), and a reflection mirror. The image forming apparatus 100 shown in FIG. 1 uses a LSU. The exposure unit 1 forms an electrostatic latent image corresponding to an image data on the photosensitive drum 3 by exposure in accordance with the input image data. The developing unit 2 develops the electrostatic latent image formed on the photosensitive drum 3 into a visible image by the toners of the respective colors. The photosensitive drum 3 is arranged at the central part of the image forming apparatus 100 to form an electrostatic latent image or a toner image corresponding to the input image data on the surface thereof. The cleaner unit 4 develops and transfers the electrostatic latent image formed on the surface of the photosensitive drum 3, after which the residual toner is removed and recovered from the surface of the photosensitive drum 3. The charging unit 5 charges the surface of the photosensitive drum 3 uniformly to a predetermined potential. The charging unit 5 is of either the roller type or brush type in contact with the photosensitive drum 3 or a charger type out of contact with the photosensitive drum 3. The image forming apparatus 100 shown in FIG. 1 includes a charging unit of charger type.

A transfer conveying belt unit 8 is arranged under the photosensitive drum 3. The transfer conveying belt unit 8 includes a transfer belt 7, a transfer belt driving roller 71, a transfer belt tension roller 73, transfer belt driven rollers 72, 74, transfer rollers 6*a*, 6*b*, 6*c*, 6*d*, and a transfer belt cleaning unit 9. In the description that follows, the four transfer rollers 6*a*, 6*b*, 6*c*, 6*d* corresponding to the respective colors are referred to collectively as a transfer roller 6.

The transfer belt driving roller 71, the transfer belt tension roller 73, the transfer roller 6 and the transfer belt driven rollers 72, 74 support in tension and rotationally drive the transfer belt 7 in the direction of white arrow in FIG. 1. The transfer roller 6 is rotatably supported on the housing of the transfer conveying belt unit 8, and has a metal shaft of 8 to 10 mm in diameter as a base. The surface of the base is covered with a conductive elastic material such as EPDM (ethylene propylene diene monomer) or foamed urethane. The transfer roller 6 is capable of applying, through the conductive elastic material, a high voltage opposite in polarity to the charging polarity of the toner uniformly to the recording paper. The toner image formed on the photosensitive drum 3 is transferred to the transfer belt 7 or the recording paper adsorbed to and conveyed on the transfer belt 7.

The transfer belt 7 is endlessly formed of a film of polycarbonate, polyimide, polyamide, polyvinylidene fluoride, polytetrafluoroethylene polymer, ethylene tetrafluoroethylene polymer or the like having, a thickness of about 100 to 150 $\mu$m in contact with the photosensitive drum 3. The toner images of the respective colors formed on the photosensitive drum 3 are sequentially transferred onto the recording paper attached to and conveyed on the transfer belt 7 thereby to form a multicolor toner image. The transfer belt cleaning unit 9 removes and recovers the color matching adjustment toner and the process control toner directly transferred to the transfer belt 7 and the toner attached by contact with the photosensitive drum 3.

In order to detect the color matching adjustment image (patch image) formed on the transfer belt 7, a registration detecting sensor 21 is arranged at a position before the transfer belt cleaning unit 9 where the transfer belt 7 has passed through the image forming station 80. The registration detecting sensor 21 detects the concentration of the patch image formed on the transfer belt 7 by the image forming station. The patch image formed on the transfer belt 7 is explained in detail later. Also, in order to detect the internal temperature and humidity of the image forming apparatus 100, a temperature/humidity sensor 22 is arranged in the neighborhood of a processing unit free of a sharp temperate or humidity change.

In the image forming station 80 of the image forming apparatus 100 having the above-mentioned configuration, an electrostatic latent image is formed on the photosensitive drum 3 by the exposure unit 1 exposing the latent image at a predetermined timing based on the input image data. Then, a visible toner image is formed from the electrostatic latent image by the developing unit 2. This toner image is transferred to the transfer belt 7 or the recording paper attached to and conveyed on the transfer belt 7.

The transfer belt 7 is rotationally driven by the transfer belt driving roller 71, the transfer belt tension roller 73, the transfer belt driven rollers 72, 74 and the transfer roller 6. The toner images of the respective color components are sequentially transferred, in superposed relation with each other, onto the transfer belt 7 or the recording paper attached to and conveyed on the transfer belt 7 thereby to form a multicolor toner image. The multicolor toner image, if formed on the transfer belt 7, is further transferred onto the recording paper.

In the image forming apparatus 100 according to this embodiment, the toner image of each color component formed in the image forming station 80 is transferred onto the transfer belt 7 at the time of color matching adjustment. In the process, a reference toner image (hereinafter referred to as the reference patch image) of one of the color components is transferred onto the transfer belt 7. Then, the toner images of other color components of which the color misregistration is to be corrected (hereinafter referred to as the correction patch images) are transferred onto the reference patch image.

In addition to the component parts for color matching adjustment, the image forming apparatus 100 comprises a paper feed tray 10, paper discharge trays 15, 33 and a fixation unit 12. The paper feed tray 10 is for storing the recording paper for recording an image. The discharge paper trays 15, 33 are trays where sheets of the recording paper with an image recorded thereon are placed. The paper discharge tray 15 is arranged in the upper part of the image forming apparatus 100 to discharge the printed recording paper face down. The paper discharge tray 33, on the other hand, is arranged on the side of the image forming apparatus to discharge the printed recording paper face up. The fixation unit 12 includes a heat roller 31 and a pressure roller 32. The heat roller 31 is controlled to have a predetermined temperature by turning on/off the heating means such as a heater lamp based on the detected temperature value of a temperature sensor (not shown). The heat roller 31 and the pressure roller 32 are rotated while holding therebetween the recording paper with the toner image transferred thereto, so that the toner image is formed on the recording paper by thermocompression bonding with the heat of the heat roller 31.

The operation of the image forming apparatus 100 having the configuration described above is explained below.

Once the image data is input to the image forming apparatus 100, the exposure unit 1 exposes the input image data according to the correction value determined by the color matching adjustment described later thereby to form an electrostatic latent image on the photosensitive drum 3. This electrostatic latent image is developed into a toner image by the developing unit 2. The recording paper stored in the paper feed tray 10, on the other hand, is separated into individual sheets by a pickup roller 16 and conveyed onto a paper conveying route 11 and temporarily held in a registration roller 14. The registration roller 14, based on the detection signal of the pre-registration detection switch not shown, controls the forward end of the toner image on the photosensitive drum 3 to such a timing as to register with the forward end of the toner image forming area on the recording paper, and conveys the recording paper to the transfer belt 7 in keeping with the rotation of the photosensitive drum 3. The recording paper is conveyed by being attached on the transfer belt 7.

The toner image is transferred from the photosensitive drum 3 through the transfer belt 7 to the recording paper by the transfer roller 6 arranged in opposed relation with the photosensitive drum 3. The transfer roller 6 is impressed with a high voltage of an opposite polarity to the toner, whereby the toner image is impressed on the recording paper. Four types of toner images corresponding to the respective colors are sequentially superposed on the recording paper conveyed by the transfer belt 7. After that, the recording paper is conveyed to the fixation unit 12 so that the toner images are fixed on the recording paper by thermocompression bonding. A convey changeover guide 34 switches the conveying routes to convey the recording paper fixed with the toner images to the discharge paper tray 33 or the paper conveying route 35. The recording paper conveyed to the paper conveying route 35 are conveyed along a paper conveying route 37 by transit rollers 36, 38, and discharged onto the discharge paper tray 15 by the paper delivery roller 39. Upon completion of transfer to the recording paper, the cleaner unit 4 removes and recovers the toner remaining on the photosensitive drum 3. Also, the transfer belt cleaning unit 9 removes and recovers the toner attached on the transfer belt 7 thereby to end the series of image forming operation.

According to this embodiment, the direct transfer system is employed, that is, the recording paper is carried on the transfer belt 7, and the toner images formed on the photosensitive drums 3*a* to 3*d* are directly transferred in superposed relation with each other on the recording paper. Nevertheless, a similar effect can of course be achieved by an image forming apparatus of intermediate transfer system in which the toner images formed on the photosensitive drums 3*a* to 3*d* are transferred in superposed relation onto the transfer belt 7, and then transferred to the recording paper collectively thereby to form a multicolor image.

Figure 2:
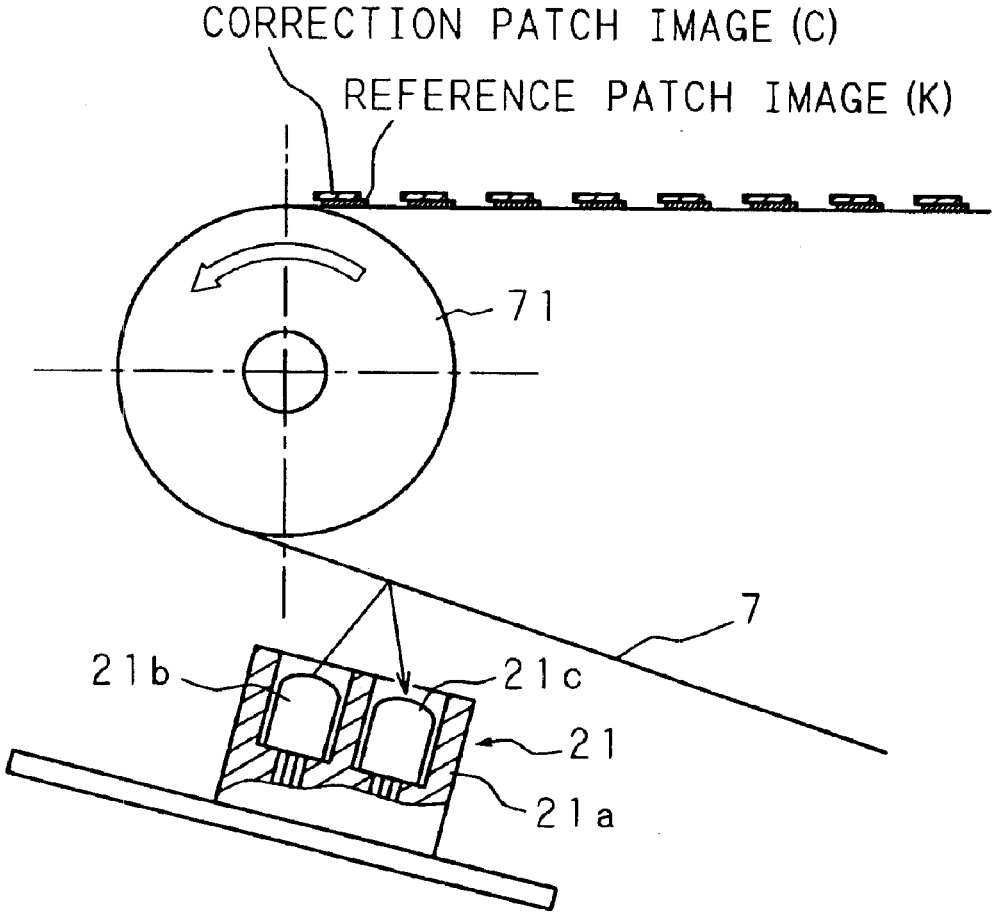
FIG. 2 is a schematic diagram for explaining the operation of a registration detecting sensor.

FIG. 2 is a schematic diagram for explaining the operation of the registration detecting sensor 21. The transfer belt 7 is rotationally driven by the transfer belt driving roller 71 of the transfer conveying belt unit 8. Once the reference patch image (in black, for example) and the correction patch image (in cyan, for example) formed on the transfer belt 7 have reached the position facing the registration detecting sensor 21, the concentration of the reference patch image and the correction patch image on the transfer belt 7 is detected by the registration detecting sensor 21.

The registration detecting sensor 21 includes a luminous unit 21*b* having a LED in a parallelopipedal housing 21*a* and a photo-detector 21*c* having a PD (photodiode). The registration detecting sensor 21 radiates light on the transfer belt 7 from the luminous unit 21*b*, and the light reflected on the transfer belt 7 is detected by the photo-detector 21*c* thereby to detect the concentration of the reference patch image and the correction patch image. Based on the result of this detection, the exposure timing of the exposure unit 1 is corrected thereby to correct the timing of writing on the photosensitive drum 3. This correction process is executed in similar fashion also for other colors to be corrected such as magenta (M) and yellow (Y). Although this embodiment employs black (K) as a reference patch image, another color may alternatively be used, in which case black (K) constitutes a color to be corrected.

In the registration detecting sensor 21, the luminous unit 21*b* and the photo-detector 21*c* are arranged in parallel to the direction in which the transfer belt 7 is driven, as shown in FIG. 2. The invention, however, is not limited to this configuration, but the luminous unit 21*b* and the photo-detector 21*c* may be arranged in the direction perpendicular to the direction in which the transfer belt 7 is driven. Also, according to this embodiment, the processing speed to form an image is set to 100 mm/sec, and the registration detecting sensor 21 is activated in the sampling period of 2 msec.

Figure 3:
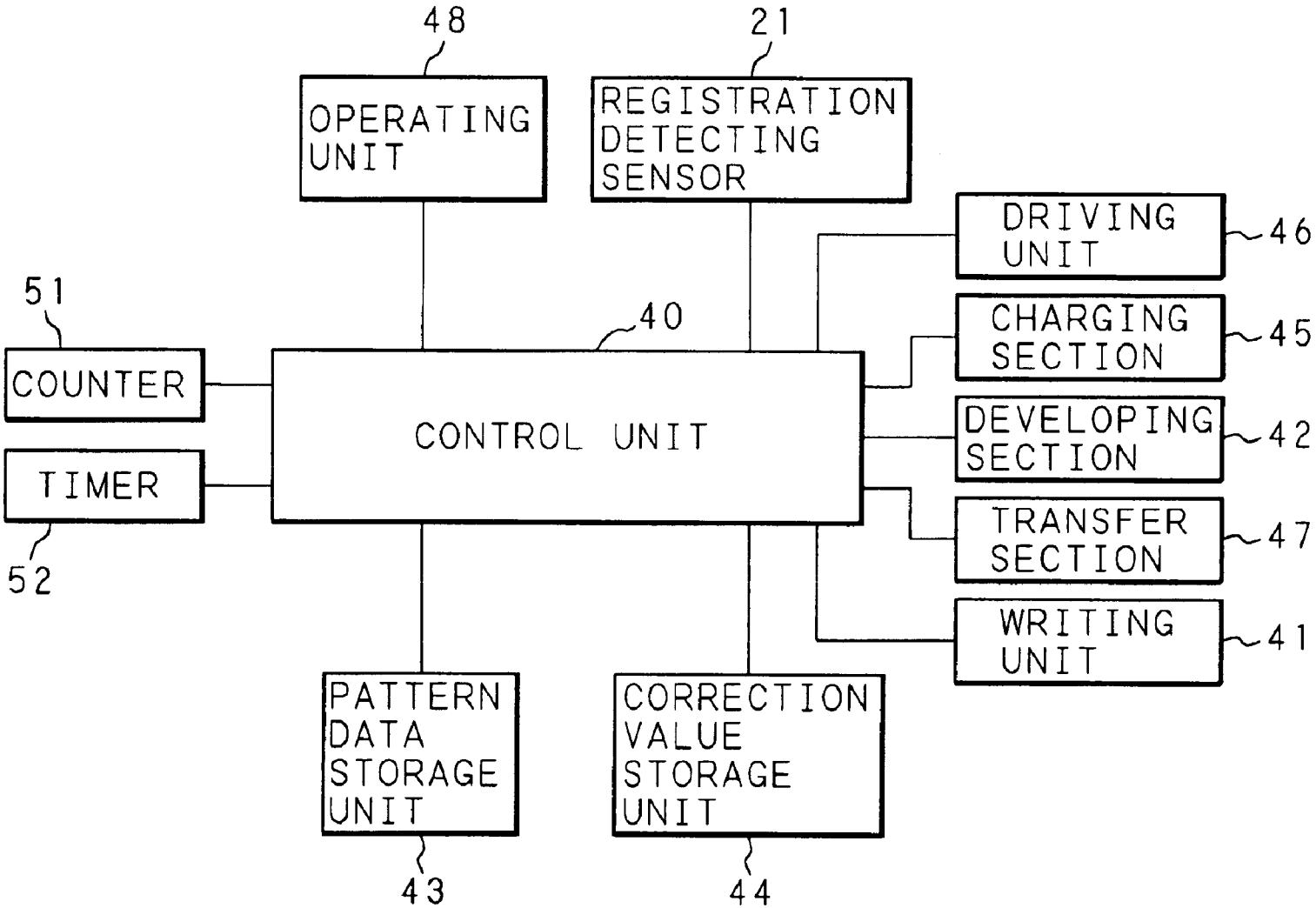
FIG. 3 is a block diagram showing an internal configuration of an image forming apparatus according to this invention.

FIG. 3 is a block diagram showing an internal configuration of the image forming apparatus 100. The image forming apparatus 100 comprises a control unit 40 including a CPU, and is connected through buses with such hardware as the registration detecting sensor 21, a writing unit 41, a developing section 42, a pattern data storage unit 43, a correction value storage unit 44, a charging section 45, a driving unit 46 and an operating unit 48.

In the case where an operation instruction is issued from the control unit 40 to the registration detecting sensor 21, the concentration of the correction patch image and the reference patch image formed on a transfer section 47 having the transfer belt 7 is measured to obtain a detection value. Based on this detection value, a correction value for the exposure timing of the exposure unit 1 is determined. The correction value thus determined is stored in the correction value storage unit 44.

In forming an image on the recording paper, the control unit 40 performs a series of image forming operations based on the correction value stored in the correction value storage unit 44. Specifically, the writing unit 41 having the exposure unit 1 shown in FIG. 1 is controlled by the control unit 40 in such a manner as to be exposed at a timing corresponding to the correction value stored in the correction value storage unit 44. This exposure forms an electrostatic latent image on the photosensitive drum 3 charged by the charging section 45. Then, the electrostatic latent image is developed into a visible toner image by the developing section 42 having the developing unit 2. Also, the driving unit 46 having the transfer belt driving roller 71, etc. is driven by the control unit 40, so that the toner image is transferred to the transfer section 47 having the transfer belt 7.

The operating unit 48 has operating keys such as switches or buttons (not shown) to receive various instructions from the user. The instructions received by the operating unit 48 include an instruction to start or suspend the image forming operation, an instruction to forcibly discharge the recording paper and an instruction to execute the color matching adjustment. Upon receipt of the color matching adjustment instruction from the operating unit 48, the control unit 40 carries out the color matching adjustment by controlling the various parts of the image forming apparatus 100.

Further, the control unit 40 is connected with a counter 51 for counting at least one of the rotational speed of the photosensitive drum 3 and the number of images formed, and a timer 52 for measuring the time elapsed after execution of the color matching adjustment. Therefore, the control unit 40 may be controlled to carry out the color matching adjustment either in accordance with the rotational speed of the photosensitive drum 3 or the number of images formed on one hand, or in the case where the time measurement of the timer 52 exceeds a predetermined value on the other hand. The timer 52 may be controlled to be reset each time the color matching adjustment is carried out and to carry out the color matching adjustment in accordance with the time indicated by the timer 52.

In the case where the color matching adjustment is carried out using the image forming apparatus 100 according to this embodiment, the position where the image of each color component (correction patch image) to be corrected with respect to a reference image (reference patch image) is formed is sequentially changed to form a predetermined detection pattern, and the average concentration value in the image forming area of the particular detection pattern is detected by the registration detecting sensor 21. Based on the result of detection, the position where the correction patch image is to be formed is determined in such a manner as to assure satisfactory superposition of the reference patch image and the correction patch image. According to this embodiment, two different types of detection patterns (a first detection pattern and a second detection pattern) are used as described later. From the result of detecting the average concentration value using the two detection patterns, a candidate value of the position where the correction patch image is to be formed is acquired, and an image forming position conforming to the candidate value acquired from each detection pattern is determined thereby to carry out the color matching adjustment.

A color matching adjustment method using the image forming apparatus 100 according to this embodiment is described in detail below.

According to this embodiment, a black (K) toner image is used as a reference patch image, and a cyan (C) toner image as a correction patch image. By way of explanation, assume that the range of color matching adjustment covers 101 dots (from the starting position of dot 0 to the ending position of dot 100) in the direction in which the transfer belt 7 is driven. The colors of the toner image used as the reference patch image and the correction patch image are not specifically limited and may be other colors (magenta or yellow) than black and cyan. Also, the color matching adjustment range is not limited to 101 dots, but may be either smaller or larger. Further, the adjustment range may be adapted for change in accordance with the prevailing situation. In any case, a long time is required for color matching adjustment in the case where the color matching adjustment range is large, and vice versa.

The color matching adjustment with the image forming apparatus 100 according this embodiment is carried out by forming a reference patch image and a correction patch image in the direction (hereinafter referred to as the main scanning direction) perpendicular to the direction (hereinafter referred to as the sub-scanning direction) in which the transfer belt 7 is driven.

Figure 4:
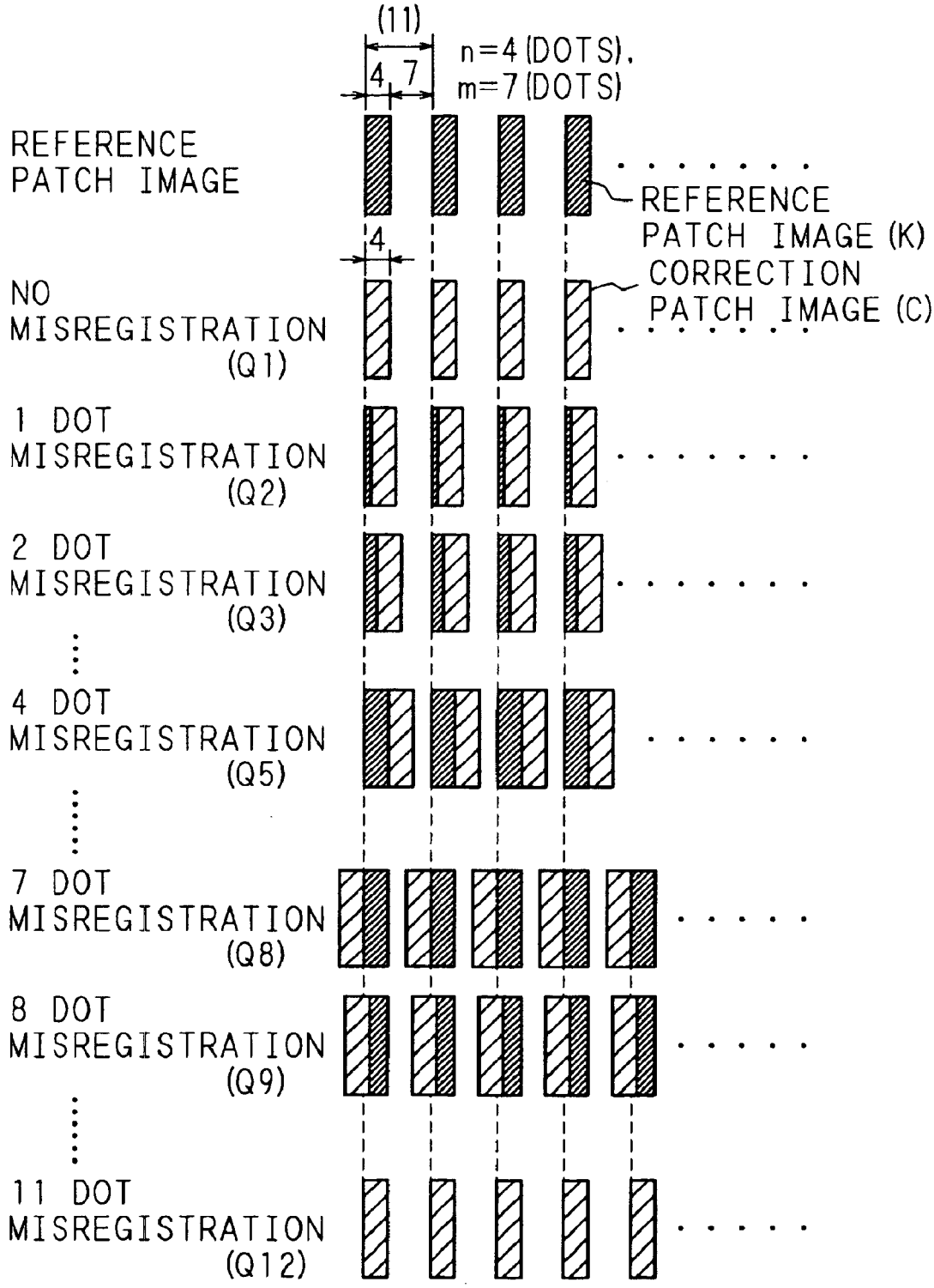
FIG. 4 is a schematic diagram for explaining the relative positions of reference patch images and correction patch images in a first detection pattern.

FIG. 4 is a schematic diagram for explaining relative positions of the reference patch images and the correction patch images for the first detection pattern. The first detection pattern is configured of a plurality of lines (hereinafter referred to as the reference lines) with black (K) reference patch images arranged in parallel to each other in grid form, and a plurality of lines (hereinafter referred to as the correction lines) with cyan (C) correction patch images arranged in parallel to each other in grid form. The lines each have a width n of 4 dots, and an interval m of 7 dots. In this assumed case, the pitch d between the lines is (n+m) dots (11 dots).

In forming the first detection pattern, the first step is to form the reference lines on the transfer belt 7, followed by forming, in superposed relation with the reference lines, the correction lines having the same width n and the same interval m as the reference lines. The reference lines and the correction lines are each formed on the order of several tens to several hundreds of sets. FIG. 4 shows the manner in which 4 to 5 sets of the reference lines and the correction lines are formed.

In view of the fact that the correction lines are superposed on the reference lines, the reference lines are completely hidden under the correction lines in the case where the image forming positions of the reference lines and the correction lines are completely coincident with each other (the state Q1 in FIG. 4). With the increase in the difference between the image forming positions of the reference lines and the correction lines, the area where the reference lines appear expands progressively to such an extent that the reference lines and the correction lines are completely out of register with each other when the difference reaches n dots (the state Q5 in FIG. 4). As long as the difference in the image forming positions between the reference lines and the correction lines is between n and m dots inclusive, both lines exhibit the maximum width (the states Q5 to Q8 in FIG. 4). With a further displacement of the image forming position of the correction lines, the area where the reference lines appear is correspondingly decreased to such an extent that the correction lines come to be completely superposed on the reference lines again when the difference reaches m+n dots (the state Q12 in FIG. 4).

Specifically, in accordance with the manner in which the correction lines are displaced from the reference lines, the ratio between the area where the reference lines appear and the area where the correction lines appear is varied. Therefore, this ratio can be detected as an average concentration value of the image. More specifically, the transfer belt 7 formed with the two types of lines is irradiated with light from the luminous unit 21*b* of the registration detecting sensor 21, and the light reflected from the two types of lines and the transfer belt 7 are received by the photo-detector 21*c*. The transfer belt 7 is formed of a glossy material. In the case where the black (K) reference lines are covered completely by the comparatively bright cyan (C) correction lines (the state Q1 in FIG. 4), therefore, the reflection intensity becomes maximum. On the contrary, the reflection intensity is minimum in the case where the reference lines and the correction lines are completely out of register with each other (the states Q5 to Q8 in FIG. 4). Specifically, the average concentration value in the image forming area can be detected by detecting the amount of the light reflected from the transfer belt 7 by the registration detecting sensor 21.

The second detection pattern, like the first detection pattern, is configured of reference lines and correction lines. Unlike the first detection pattern, however, the line interval m is 5 dots for the second detection pattern. Incidentally, the line width n is 4 dots for both types of lines, and the pitch d of lines is 9 dots.

Figure 5:
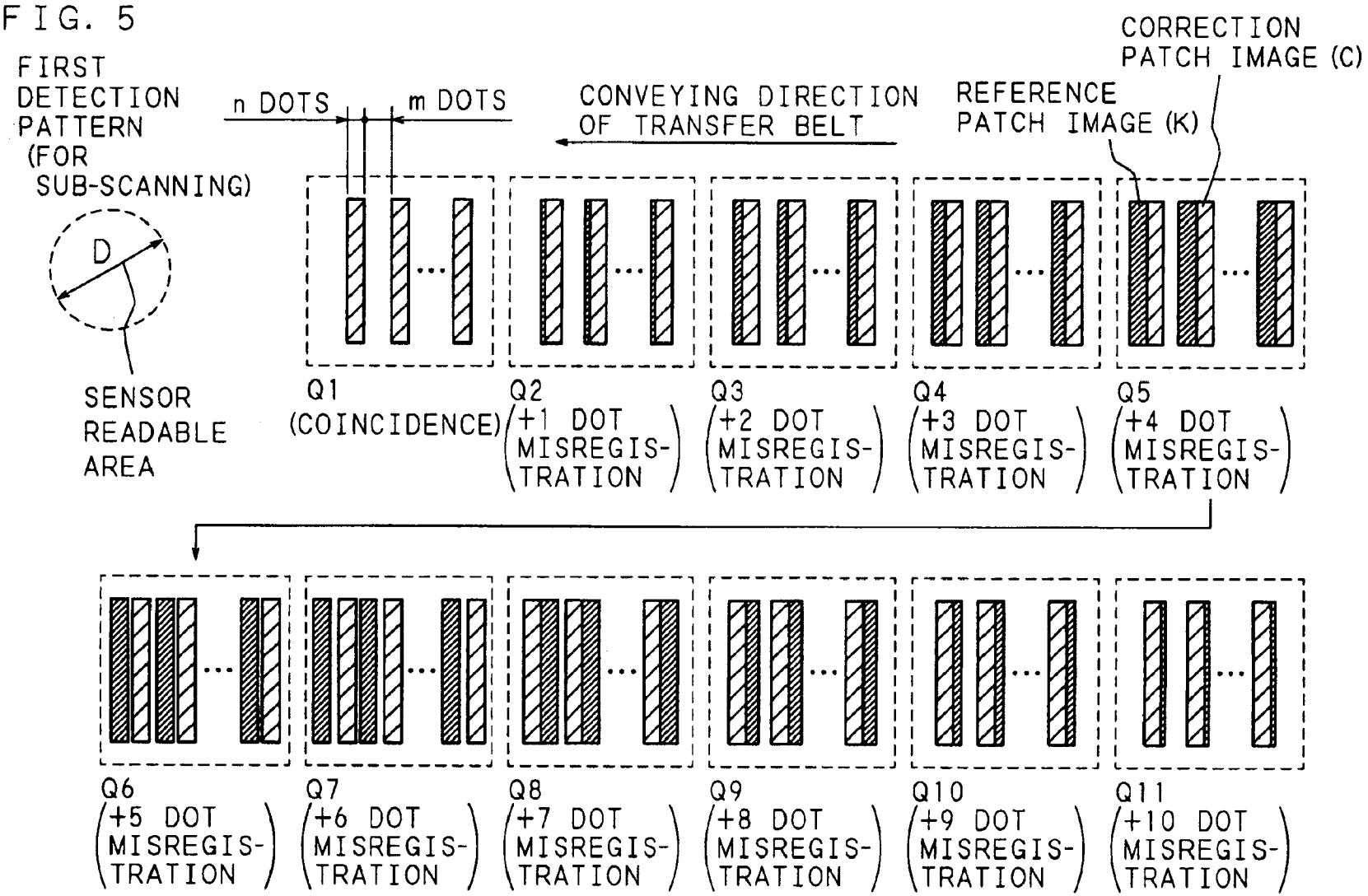
FIG. 5 is a diagram for explaining the color matching adjustment for eliminating a color misregistration in the sub-scanning direction.

FIG. 5 is a diagram for explaining the color matching adjustment for eliminating the color misregistration in the sub-scanning direction. The registration detecting sensor 21 detects the average concentration value of the reference lines and the correction lines within the sensor readable area D shown in FIG. 5. According to this embodiment, the sensor readable area D is about 10 mm in diameter so that the color misregistration detection error due to a minuscule vibration or the like is averaged out.

As described above, the concentration of the reference lines and the correction lines on the transfer belt 7 is varied depending on the manner in which the reference lines and the correction lines are superposed on the transfer belt 7. Specifically, the result of concentration detection of the registration detecting sensor 21 is varied with the total area occupied by the reference lines and the correction lines formed on the surface of the transfer belt 7. When this area is minimum (the reference lines and the correction lines are in completely superposed relation with each other), the amount of light absorbed into the correction lines is reduced while the amount of light reflected from the transfer belt 7 becomes maximum, so that the detection value of the registration detecting sensor 21 becomes a local maximum. At the same time, the average concentration value in the image forming area (the sensor readable area) becomes a local maximum. In the case where the total area of the reference lines and the correction lines formed on the surface of the transfer belt 7 becomes maximum (the reference lines and the correction lines are completely displaced from each other), on the contrary, the detection value of the registration detecting sensor 21 becomes a local minimum, so that the average concentration in the image forming area assumes a local minimum value. By the way, in the case where the transfer belt 7 is transparent, a similar detecting operation is possible with the registration detecting sensor 21 of transmission type as well as reflection type.

From the description above, it is understood that the detection value of the registration detecting sensor 21 becomes a local maximum (or a local minimum for a transparent transfer belt 7) in the case where the reference lines and the correction lines are completely superposed. By forming an image under the condition where the detection value becomes a local maximum, therefore, the state can be achieved in which the reference lines and the correction lines are completely superposed. According to this embodiment, the color matching adjustment is carried out taking note of the fact that the detection value of the registration detecting sensor 21 becomes a local maximum in the case where the reference lines and the correction lines are in completely superposed relation. Incidentally, the color matching adjustment can of course be carried out taking note of the state in which the reference lines and the correction lines are completely displaced from each other, i.e. the state in which the detection value of the registration detecting sensor 21 becomes a local minimum.

According to this embodiment, in order to detect a satisfactory superposed state between the reference lines and the correction lines, the correction lines formed on the reference lines are sequentially displaced at an arbitrary ratio so that the average concentration value is detected for each state while changing the superposed state between the two types of lines. Based on the result of this detection, the relative positions of the two types of lines are determined in such a mannerso that the average concentration value is a local maximum. Specifically, a plurality of lines each having a width n of 4 dots and an interval m of 7 dots are used for color matching adjustment with the first detection pattern. In the state where the reference lines and the correction lines are in completely superposed relation, like in the state Q1 shown in FIG. 5, the reference lines are completely covered by the correction lines. At this time, the registration detecting sensor 21 detects the average concentration value of the line patterns repeated with the correction line width of 4 dots and the line interval of 7 dots (transfer belt 7).

Next, in the case where the correction lines are formed one dot away in the subsidiary scanning direction from the image forming position of the reference lines, as shown by the state Q2 in FIG. 5, the reference lines are not completely covered by the correction lines, i.e. the two types of lines are displaced from each other. Under this condition, the registration detecting sensor 21 detects the average concentration value of the image including the reference line corresponding to 1 dot, the correction line corresponding to 4 dots and the line interval (transfer belt 7) corresponding to 6 dots. Specifically, the registration detecting sensor 21 detects the average concentration value of the repeated images including the reference lines and the correction lines having a line width of 5 dots and a line interval of 6 dots.

As described above, in the case where the correction lines are formed by being shifted one dot each time with respect to the reference lines from the state (Q1) in which the reference lines and the correction lines are completely superposed one on the other, the superposed state of the reference lines and the correction lines undergoes a change as indicated by Q1 to Q11 in FIG. 5. In the case where the displacement reaches +11 dots from the state Q1 shown in FIG. 5, the width of 4 dots and the interval of 7 dots of the correction lines are repeated, and the reference lines and the correction lines come to be completely superposed again. Specifically, the state in which the correction lines are displaced by 11 dots is identical to the state before the correction lines are displaced from the reference lines. Each time the correction lines are displaced by 11 dots, therefore, the same state is repeated. In the case where the superposed state of the two types of lines is found while displacing the image forming position of the correction lines by one dot each time from the reference lines for a given 11-dot section in the sub-scanning direction in a predetermined color matching adjustment range, therefore, only one state where the two types of lines are completely superposed can be detected.

Figure 6:
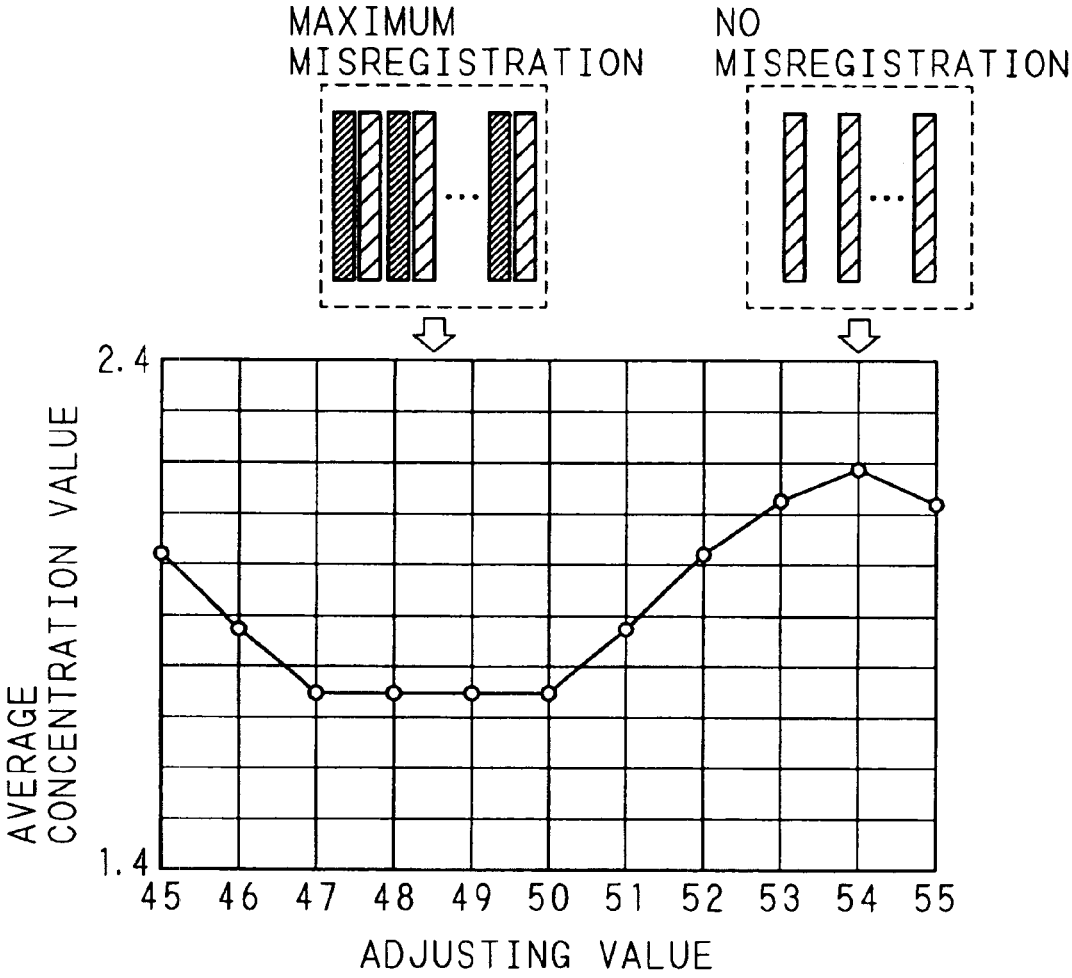
FIG. 6 is a graph showing an example of the detection result of the color matching adjustment using the first detection pattern.

FIG. 6 is a graph showing an example of the detection result in the color matching adjustment carried out using the first detection pattern. The change in the superposed state between the reference lines and the correction lines is detected as the average concentration value within the readable area of the registration detecting sensor 21 (within the area having a diameter D of 10 mm), and the average concentration value is plotted with respect to the image forming position of the correction lines. Then, a polygonal graph as shown in FIG. 6 is obtained. The abscissa represents an adjusting value corresponding to the image forming position of the correction patch image, and the ordinate the detection value of the registration detecting sensor 21 (average concentration value within the detection area). The "adjusting value" is defined as a value corresponding to the image forming position of the correction lines, or specifically, a set value of the exposure timing of the exposure unit 1*b*. According to this embodiment, to simplify the explanation, assume that the adjusting value is given by an integer such as "1", "2", "3" and so on and that the image forming position of the correction lines is displaced by one dot per unit adjusting value. Also, assume that the reference lines are formed at a predetermined exposure timing.

As shown in the graph of FIG. 6, the average concentration value detected by the registration detecting sensor 21 indicates a change corresponding to the image forming position (adjusting value) of the correction lines. In the case where the adjusting values in the range of "45" to "55" are to be detected, for example, the average concentration value is a local maximum for the adjusting value "54". This indicates that in the case where the correction lines of the first detection pattern are formed by controlling the exposure timing of the exposure unit 1*b* with this adjusting value, on the contrary, the correction lines are in completely superposed relation with the reference lines. Specifically, after the detection result is obtained, the adjusting value associated with the local maximum average concentration value is stored in the correction value storage unit 44, and when forming an image of the correction lines, the exposure timing of the exposure unit 1*b* is controlled in accordance with the adjusting value in store. In this way, the correction lines can be completely superposed on the reference lines. On the other hand, the graph indicates that the average concentration value becomes a local minimum with the reference lines and the correction lines completely displaced from each other for the adjusting values of "47" to "50". Incidentally, with regard to the first detection pattern, the line interval of each reference line is 7 dots and the width of each correction line is 4 dots. Therefore, the states Q5 to Q8 (FIG. 5) where each correction line is located in the gap between the reference lines cannot be distinguished based on the average concentration value.

Figure 7:
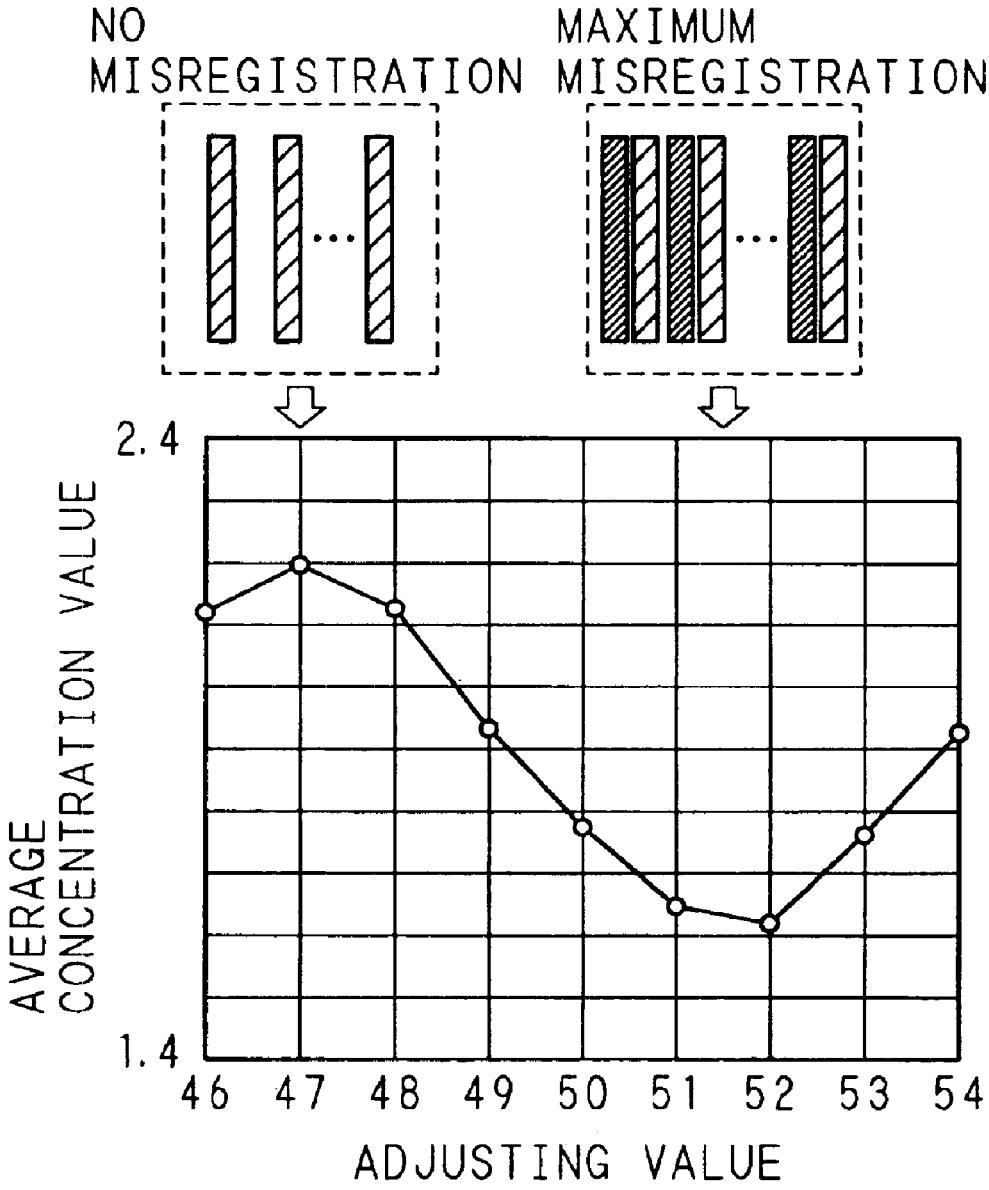
FIG. 7 is a graph showing an example of the detection result of the color matching adjustment using a second detection pattern.

FIG. 7 is a graph showing an example of the detection result in the color matching adjustment carried out using the second detection pattern. As in FIG. 6, the abscissa represents the adjusting value corresponding to the image forming position of the correction lines, and the ordinate the detection value of the registration detecting sensor 21 (the average concentration value in the detection area). FIG. 7 shows the average concentration value detected in the adjusting value range of "46" to "54" while shifting the image forming position (adjusting value) of the correction lines by one dot each time with respect to the reference line. The graph of FIG. 7 indicates that the average concentration value is local maximum for the adjusting value "47", and the reference lines are in completely superposed relation with the correction lines in the case where the correction lines of the second detection pattern are formed by controlling the exposure timing of the exposure unit 1*b* with the adjusting value "47". Also, the average concentration value is shown to become local minimum with the reference lines and the correction lines completely displaced from each other for the adjusting value "52".

As described above, in the case where the concentration is detected sequentially while changing the adjusting value from "45" to "55" in the first detection pattern and from "46" to "54" in the second detection pattern, one local maximum value is detected in each detection section. The exposure timing of the exposure unit 1*b* is controlled by the optimum adjusting value (the adjusting value associated with the local maximum average concentration value) determined using the first detection pattern, and thus the first detection pattern is formed on the transfer belt 7. Then, the reference lines and the correction lines come to be in completely superposed relation. In the case where the exposure timing of the exposure unit 1*b* is controlled by the optimum adjusting value determined using the second detection pattern, and thus the second detection pattern is formed on the transfer belt 7, on the other hand, the reference lines and the correction lines are superposed completely.

In the case where the exposure timing is controlled with the optimum adjusting value using the first detection pattern and the second detection pattern is formed on the transfer belt 7, however, the reference lines and the correction lines are not always superposed completely. In similar fashion, in the case where the exposure timing is controlled with the optimum adjusting value using the second detection pattern and the first detection pattern is formed on the transfer belt 7, the reference lines and the correction lines are not always superposed completely. The adjusting value indicates nothing but the position of the correction lines relative to the reference lines, and not the absolute position of the correction lines. It is necessary to find out an adjusting value whereby the reference lines and the correction lines are completely superposed for both the first and second detection patterns. An adjusting value by which the reference lines and the correction lines of the detection patterns having different pitches can be completely superposed is called a correction value. The correction value is stored in the correction value storage unit 44, and updated at the time of color matching adjustment according to this embodiment. In forming an image, the exposure timing of each exposure unit 1 is controlled in accordance with the correction value stored in the correction value storage unit 44 thereby to form a multicolor image with a corrected color misregistration.

A method of calculating an effective adjusting value (correction value) for different types of detection pattern is explained below. As described above, at the time of color matching adjustment carried out in a predetermined measurement area using the first detection pattern or the second detection pattern, a true adjusting value applicable to both the detection patterns may not be determined. According to this embodiment, the measurement area is virtually expanded taking the periodicity of each detection pattern into consideration.

Figure 8:
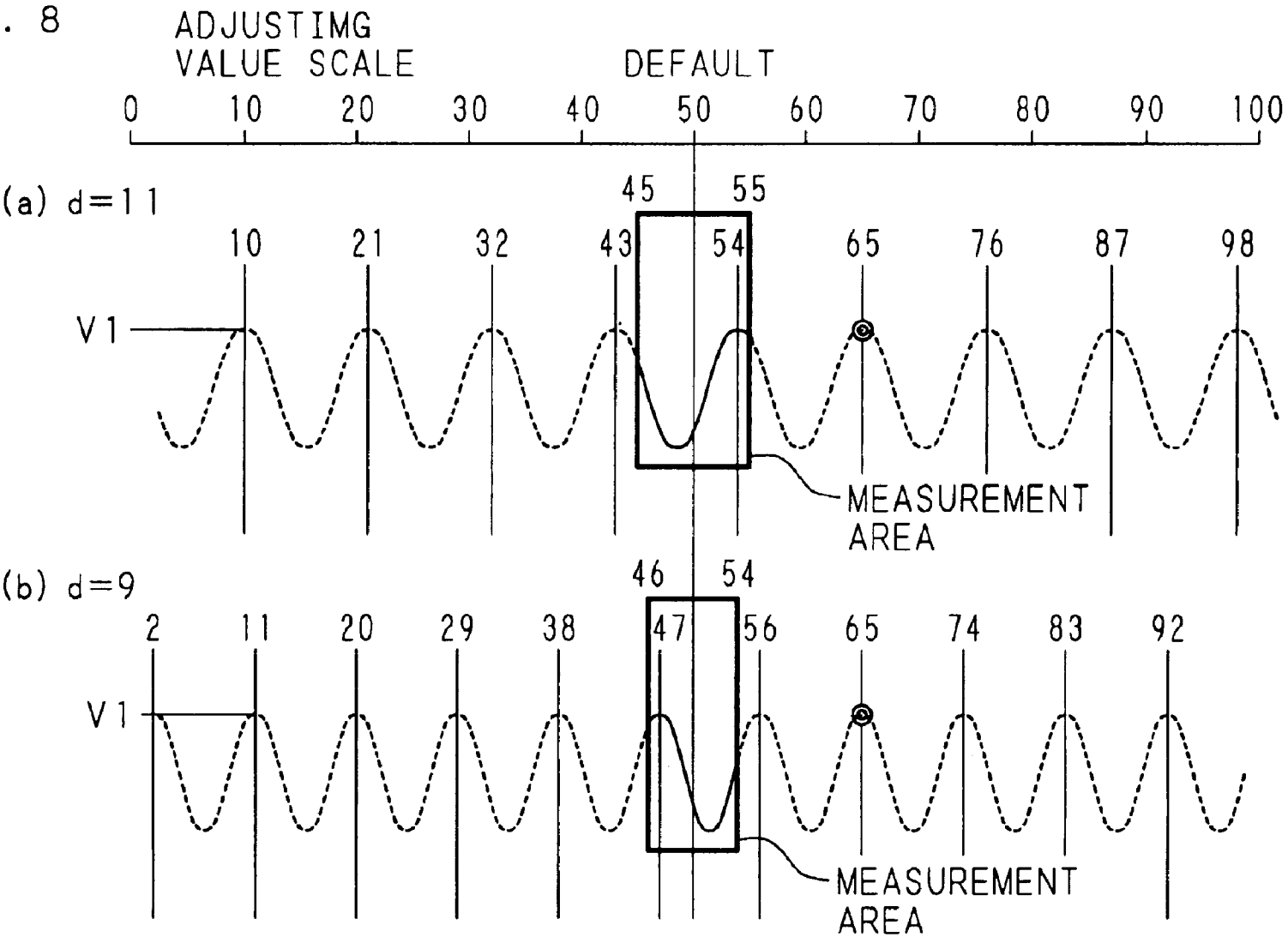
FIG. 8 is a schematic diagram for explaining the relation between a measurement area and a color matching adjustment range.

FIG. 8 is a schematic diagram for explaining the relation between the measurement area and the color matching adjustment range. FIG. 9 is a diagram showing a list of candidates for correction value determined from each detection pattern. In the first detection pattern, the reference lines and the correction lines have a pitch of 11 dots. Therefore, the measurement area is set in the adjusting value range of "45" to "55" and the average concentration value on the transfer belt 7 is detected by the registration detecting sensor 21. In this way, only one adjusting value associated with a local maximum detection value (average concentration value) in the measurement area can be determined. The adjusting value ("54") thus determined constitutes one candidate for the correction value. The adjusting value determined in this case, however, is nothing but one candidate for the correction value, as described above. Therefore, the measurement area to be searched for another candidate is required to be virtually expanded, and according to this embodiment, the adjusting value range of "0" to "100" is set as the total range of color matching adjustment (hereinafter referred to as the color matching adjustment range).

For the first detection pattern which has a periodicity of 11 dots, both the sum of and the difference between the adjusting value "54" actually determined in the measurement area and an integer multiple of 11 can be a candidate. In the color matching adjustment range for the adjusting values "0" to "100", therefore, the adjusting values "10", "21", "32", "43", "54", "65", "76", "87" and "98" shown in the upper part (d=11) of FIG. 9 constitute candidates for the correction value. In other words, in the case where the exposure timing of the exposure unit 1*b* is controlled using any one of these candidates, the reference lines and the correction lines for the first detection pattern are completely superposed.

Next, the color matching adjustment is carried out using the second detection pattern in order to determine a correction value constituting the true adjusting value from among the candidate values acquired based on the first detection pattern. The second detection pattern has a pitch of 9 dots for the reference lines and the correction lines. Therefore, the average concentration value is detected by setting the measurement area in the adjusting value range of "46" to "54". In this measurement area, the adjusting value "47" associated with the local maximum detection value is one candidate for the correction value. Further, "2", "11", "20", "29", "38", "56", "65", "74", "83" and "92", which are the sum of or the difference between an adjusting value constituting the candidate and an integer multiple of 9, constitute candidates for the correction value (in the lower part of FIG. 9 (d=9)).

As shown in FIG. 9, comparison of candidates for correction value acquired from the detection patterns of each pitch shows that only one common value (adjusting value "65") is included. In the case where the exposure timing of the exposure unit 1*b* is controlled using the adjusting value "65", therefore, the reference lines and the correction lines for the first detection pattern can be completely superposed. Similarly, the reference lines and the correction lines for the second detection pattern can be completely superposed. In other words, a candidate of a value shared by the detection patterns constitutes a correction value to be determined.

The steps of the color matching adjustment process executed by the image forming apparatus 100 according to this embodiment is explained below.

Figure 10:
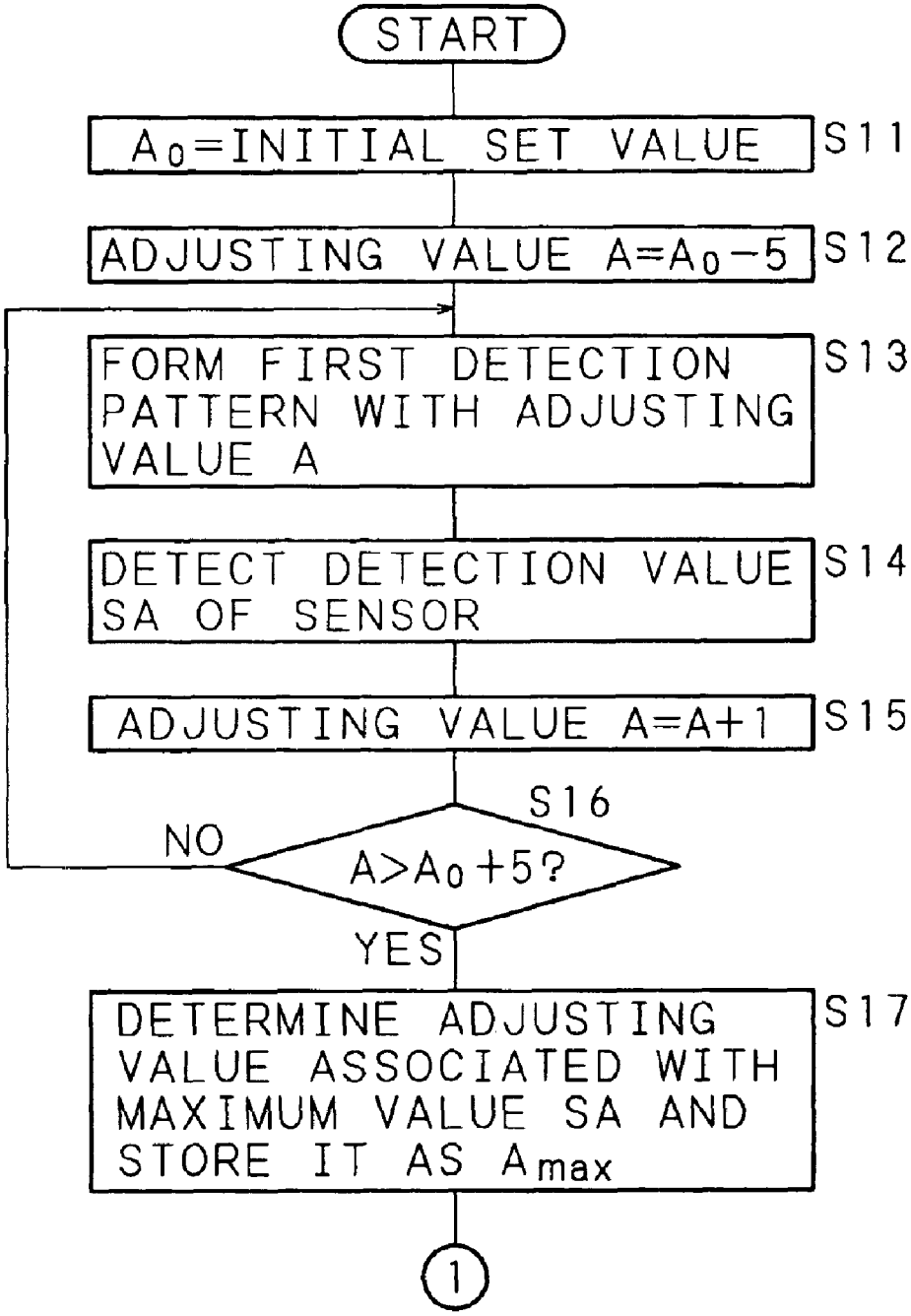
FIG. 10 is a flowchart for explaining the steps of the color matching adjustment process according to an embodiment of the invention.
Figure 11:
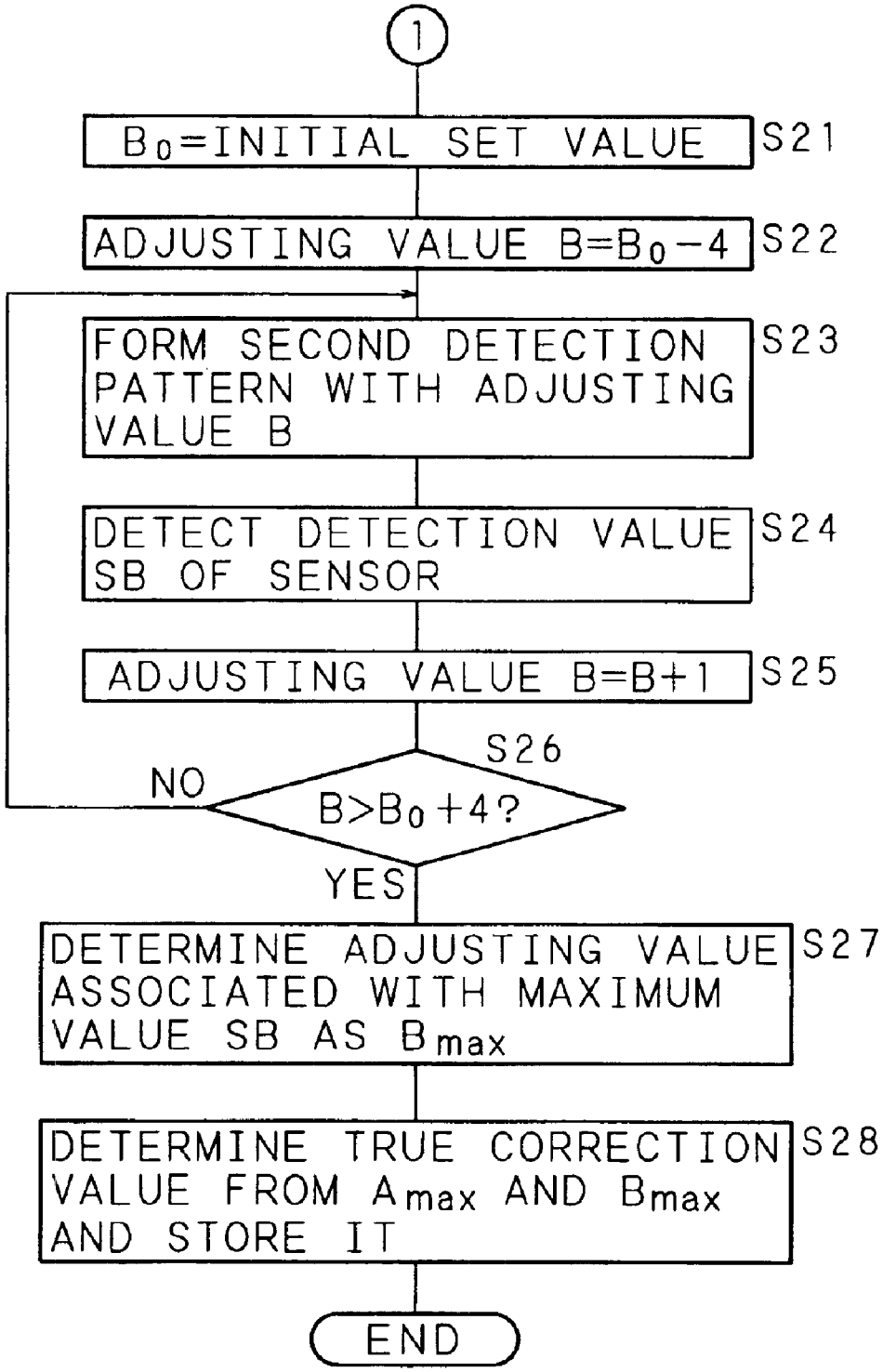
FIG. 11 is a flowchart for explaining the steps of the color matching adjustment process according to an embodiment of the invention.

FIGS. 10 and 11 are flowcharts for explaining the steps of the color matching adjustment process according to this embodiment. As described above, the color matching adjustment range is set to 101 dots, the starting point of the color matching adjustment range to dot 0 (adjusting value "0") and the ending point of the color matching adjustment range to dot 100 (adjusting value "100"). For the first detection pattern, as shown in FIG. 4, the pitch d of the image forming patterns is set to 11 dots, the width n of the reference lines and the correction lines to 4 dots, and the line interval m to 7 dots. For the second detection pattern, on the other hand, the pitch d of the image forming pattern is set to 9 dots, the width n of the reference lines and the correction lines to 4 dots, and the line interval m to 5 dots. In the flowcharts, the color matching adjustment using the first detection pattern is explained with reference to steps S11 to S17, and the color matching adjustment using the second detection pattern is explained with reference to steps S21 to S27. Also, assume that the reference lines are black (K) and the correction lines cyan (C).

First, in the control unit 40 of the image forming apparatus 100, an arbitrary position in the color matching adjustment range is determined as an initial set value (A0) (step S11), where A0 may be any value corresponding to the image forming position of the correction lines. According to this embodiment, an adjusting value indicating the exposure timing of the exposure unit 1 is used as A0. Also, the value A0 may be predetermined as the center value of the color matching adjustment range, i.e. the adjusting value "50".

Next, an adjusting value A equal to the initial set value A0 less 5 is set as a measurement starting position of the registration detecting sensor 21 (step S12). Specifically, the position displaced by 5 dots from the position corresponding to the initial set value A0 is determined as a measurement starting position. Then, the control unit 40 controls the exposure timing for the correction lines with the adjusting value A, and forms a first detection pattern on the transfer belt 7 (step S13). In the process, the reference lines are formed on the transfer belt 7 at a predetermined exposure timing fixed at the time of color matching adjustment, and in order to adjust the image forming position of the correction lines, the exposure timing of the exposure unit 1*b* is controlled with the adjusting value A so that the correction lines are formed superposed on the reference lines.

Next, in order to measure the average concentration value for the first detection pattern formed on the transfer belt 7, the detection value SA of the sensor (registration detecting sensor 21) is detected (step S14). After incrementing the adjusting value A by 1 (step S15), the control unit 40 judges whether the adjusting value A is larger than A0+5 or not (step S16), and thus whether it is displaced from the measurement area (the adjusting value range of "45" to "55", for example). In the case where it is judged that the adjusting value A is not currently more than A0+5 (NO in S16), i.e. in the case where the adjusting value A is included within the measurement range, then the process is returned to step S13, and until the adjusting value A is displaced from the measurement area, the average concentration value is repeatedly detected while shifting the image forming position of the correction lines by one dot each time.

In the case where the adjusting value A is increased beyond A0+5 and displaced from the measurement range (YES in S16), an adjusting value associated with the (local) maximum detection value SA is determined and stored as Amax (step S17). The determination as to whether the detection value SA of the registration detecting sensor 21 is maximum or not may be made immediately after obtaining the detection value SA in step S14. As an alternative, each detection value SA is temporarily held during the repeated detection process, and the maximum value is determined by comparing the detection values SA in step S17. In the case where it is determined immediately after step S14 whether the detection value SA is maximum or not, the average concentration value in the state where the reference lines and the correction lines are completely superposed (the state Q1 in FIG. 4) is required to be measured and stored beforehand, and the determination as to whether the detection value SA is maximum or not is made with the stored value as a threshold.

As described above, the same detection value SA of the registration detecting sensor 21 is assumed in the sensor readable area for the first detection pattern each time the image forming position of the correction lines is displaced with respect to the reference lines by the lines pitch (d=11 dots). Therefore, the detection process is not necessarily executed over the whole color matching adjustment range (0 dot to 100 dots). According to this embodiment, the detection value SA is acquired while shifting the image forming position of the correction lines by one dot each time within the range of 11 dots with the initial set value A0 as the center thereby to determine the adjusting value Amax associated with the maximum detection value. In the process, the adjusting value associated with the maximum detection value of the registration detecting sensor 21 outside the measurement range can be predicted as a value equal to Amax plus an integer multiple of 11.

Next, the color matching adjustment process using the second detection pattern is explained. Except that the measurement range is different, the process is basically executed in a manner similar to the color matching adjustment process using the first detection pattern. The control unit 40 first determines the initial set value B0 as an adjusting value constituting the center of the measurement area (step S21). The initial set value B0 can be arbitrarily set within the color matching adjustment range (0 to 100 dots), and may be either the same as or different from the initial set value A0 determined in step S11.

Then, in the control unit 40, the adjusting value B equal to the initial set value B0 less 4 is set as a measurement starting point of the registration detecting sensor 21 (step S22). Specifically, the line pitch of the second detection pattern is 9 dots as described above, and therefore the adjusting value B equal to the initial set value B0 less 4 is set as a measurement starting point in such a manner that the initial set value B0 is the center of the measurement range. Then, the control unit 40 controls the exposure timing of the exposure unit 1*b* with the adjusting value B, forms the second detection pattern on the transfer belt 7 (step S23), and detects the detection value SB of the sensor (the registration detecting sensor 21) for measuring the average concentration value of the second detection pattern formed on the transfer belt 7 (step S24). The adjusting value B is incremented by 1 (step S25), after which the control unit 40 judges whether the adjusting value B is larger than B0+4 or not (step S26) thereby to determine whether the adjusting value B has deviated from the measurement area (the adjusting value range of, say, "46" to "54").

In the case where it is judged that the current adjusting value B is not more than B0+4 (NO in step S26), i.e. in the case where it is judged that the adjusting value B is included within the measurement area, the process is returned to step S23, and the detection of the average concentration value is repeated while shifting the image forming position of the correction lines by one dot each time until the adjusting value B deviates from the measurement area. Once the adjusting value B is increased beyond B0+4 and displaced from the measurement area (YES in S26), an adjusting value associated with the maximum detection value SB is stored as Bmax (step S27). Incidentally, the determination as to whether the detection value SB is maximum or not may be made either by comparing, immediately after acquisition of the detection value SB in step S24, the maximum average concentration value detected in advance, or by holding each detection value SB temporarily during the repeated detection process and comparing the detection values SB in step S27.

Then, the control unit 40 determines the true correction value from Amax and Bmax in store, and stores it in the correction value storage unit 44 (step S28). The true correction value can be determined in the following manner: First, a first candidate is acquired within the color matching adjustment range from the value Amax stored in step S17, plus a value i times (i=0, ±1, ±2, . . . ) as large as 11, and then a second candidate in the color matching adjustment range is acquired from the value Bmax stored in step S27, plus a value j times (j+0, ±1, ±2, . . . ) as large as 9. By finding out an adjusting value at which the first candidate is identical with the second candidate, the true correction value is determined. The color matching adjustment described above is conducted using a detection pattern formed while shifting the correction lines along the sub-scanning direction with respect to the reference lines. Since the color misregistration occurs also in the main scanning direction, however, the color matching adjustment is preferably conducted using a detection pattern formed while shifting the correction lines in the main scanning direction in the same manner as the color matching adjustment in the sub-scanning direction.

Figure 12:
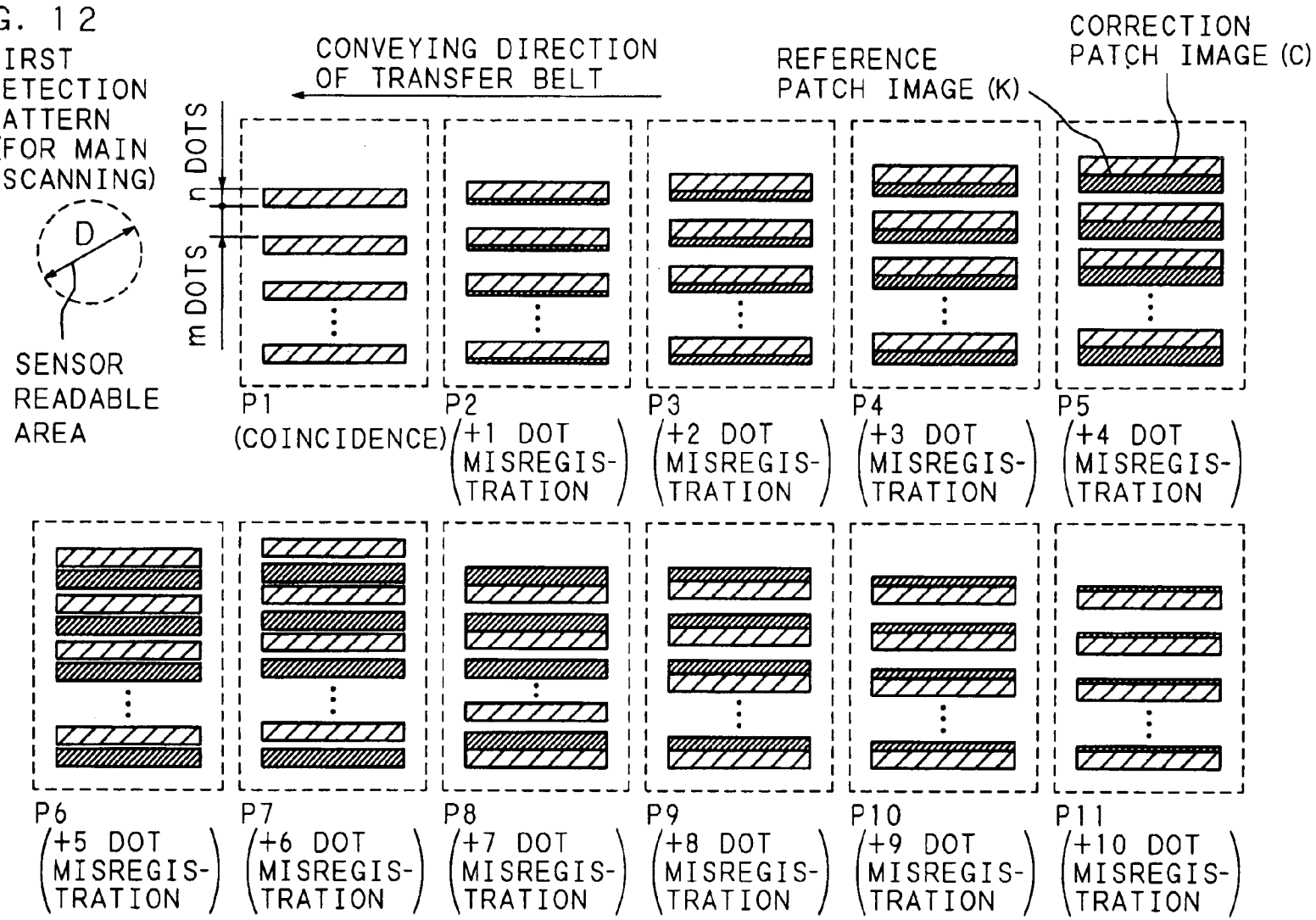
FIG. 12 is a diagram for explaining the color matching adjustment against a color misregistration in the main scanning direction.

FIG. 12 is a diagram for explaining the color matching adjustment for eliminating the color misregistration in the main scanning direction. The registration detecting sensor 21 detects the average concentration value of the reference lines and the correction lines within the sensor readable area D shown in FIG. 12. Like the detection pattern for sub-scanning, the color matching adjustment with the first detection pattern is conducted by forming the reference lines and the correction lines having a line width n of 4 dots and a line interval m of 7 dots on the transfer belt 7, while the color matching adjustment with the second detection pattern is conducted by forming the reference lines and the correction lines having a line width n of 4 dots and a line interval m of 5 dots on the transfer belt 7.

While sequentially changing the adjusting value for the image forming position of the correction lines, the two types of lines are formed, and the average concentration value of the image forming area is detected by the registration detecting sensor 21. FIG. 12 shows the first detection pattern. In the case where the correction lines are shifted by one dot each time along the main scanning direction from the state (P1) where the reference lines and the correction lines are in completely superposed relation with each other, the two types of lines come to assume the state (P5) having no superposed part, the two types of lines begin to be superposed again from the state (P9) after shifting 8 dots, and the two types of lines are completely superposed again after shifting the correction lines by 11 dots.

A technique similar to that for the sub-scanning direction is usable also for the main scanning direction. For the first detection pattern, the first step is to determine an adjusting value associated with a local maximum detection value from the measurement area of 11 dots, and an adjusting value equal to the determined adjusting value plus an integer multiple of 11 is stored as a candidate for the correction value. In order to determine the correction value from among these candidates, the color matching adjustment is conducted for the second detection pattern having a periodicity of 9 dots, and a candidate shared by the two detection patterns is determined as a correction value and stored in the correction value storage unit 44. Incidentally, the processing steps of the image forming apparatus 100 for the color matching adjustment in the main scanning direction are exactly the same as those for the sub-scanning direction and therefore are not described again.

The color matching adjustment can be carried out for one or both of the sub-scanning direction (FIG. 5) and the main scanning direction (FIG. 12). The direction in which the color matching adjustment is conducted is adapted to be selected by and received from the operating unit 48. In this way, the color misregistration for both the sub-scanning and main scanning directions can be adjusted as required, thereby producing a high image quality. By adjusting the color misregistration for one of the directions, on the other hand, the adjustment time can be shortened preferentially. According to this embodiment, the color matching adjustment range is set to 0 to 100 dots (adjusting values "0" to "100"), the line pitch d of the first detection pattern to 11 dots, and the line pitch d of the second detection pattern to 9 dots. The invention is not necessarily limited to these values, but may employ arbitrary values in accordance with the characteristics of the image forming apparatus 100. For example, the maker or the user can set the values in advance at the time of manufacture or shipment of the image forming apparatus 100.

FIGS. 13A and 13B are diagrams for explaining the relation between the candidates for the correction value found in a predetermined color matching adjustment range and the pitches of the detection pattern. In the case where the color matching adjustment is conducted using the first detection pattern having a pitch of 11 dots and the second detection pattern having a pitch of 9 dots thereby to acquire a candidate for the correction value from each detection value, only one common candidate is determined in the color matching adjustment range of 101 dots. This is by reason of the fact that even in the case where a common adjusting value is not determined in the measurement area by the color matching adjustment using each detection pattern, a common adjusting value never fails to be determined by enlarging the color matching adjustment range to the least common multiple (99 dots) of the pitches of the two types of the detection patterns.

In the case where the color matching is conducted for the color matching adjustment range of about 100 dots, therefore, the pitch of each detection pattern is not limited to the set of 11 dots and 9 dots, but the set of 12 dots and 11 dots, the set of 11 dots and 10 dots or the set of 10 dots and 8 dots may alternatively be employed. In the case where the set of 12 dots and 8 dots is used as shown in FIG. 13A, however, a plurality of candidates are coincident and therefore a unique correction value providing the true adjusting value cannot be determined. For this reason, an appropriate pitch for the two detection patterns is desirably determined in advance by the manufacturer in accordance with the color matching adjustment range. According to this embodiment, the reference lines and the correction lines having a pitch of 11 dots are used for the first detection pattern, and those having a pitch of 9 dots for the second detection pattern.

FIG. 13B shows an example of a pitch and a candidate for correction value for each detection pattern in the case where the color matching adjustment range is 20 dots. In the case where the whole color matching adjustment range is 20 dots or less, for example, the reference lines and the correction lines of 4 dots can be used as the pitch of the first detection pattern, and those of 5 dots as the pitch of the second detection pattern. In the process, the average concentration value is detected by the registration detecting sensor 21 only in the range of 9 to 12 dots and 8 to 12 dots for the reference lines and the correction lines, respectively, and therefore the amount of the developer can be reduced while at the same time shortening the adjustment time.

(Second Embodiment)

According to the first embodiment, the color matching adjustment is carried out by detecting the concentration for all the adjusting values in a predetermined measurement area. In the case where the maximum detection value can be acquired during the concentration detection using the first detection pattern, however, the detection pattern may stop being formed at the particular time point and the color matching adjustment may be conducted using the second detection pattern.

Figure 14:
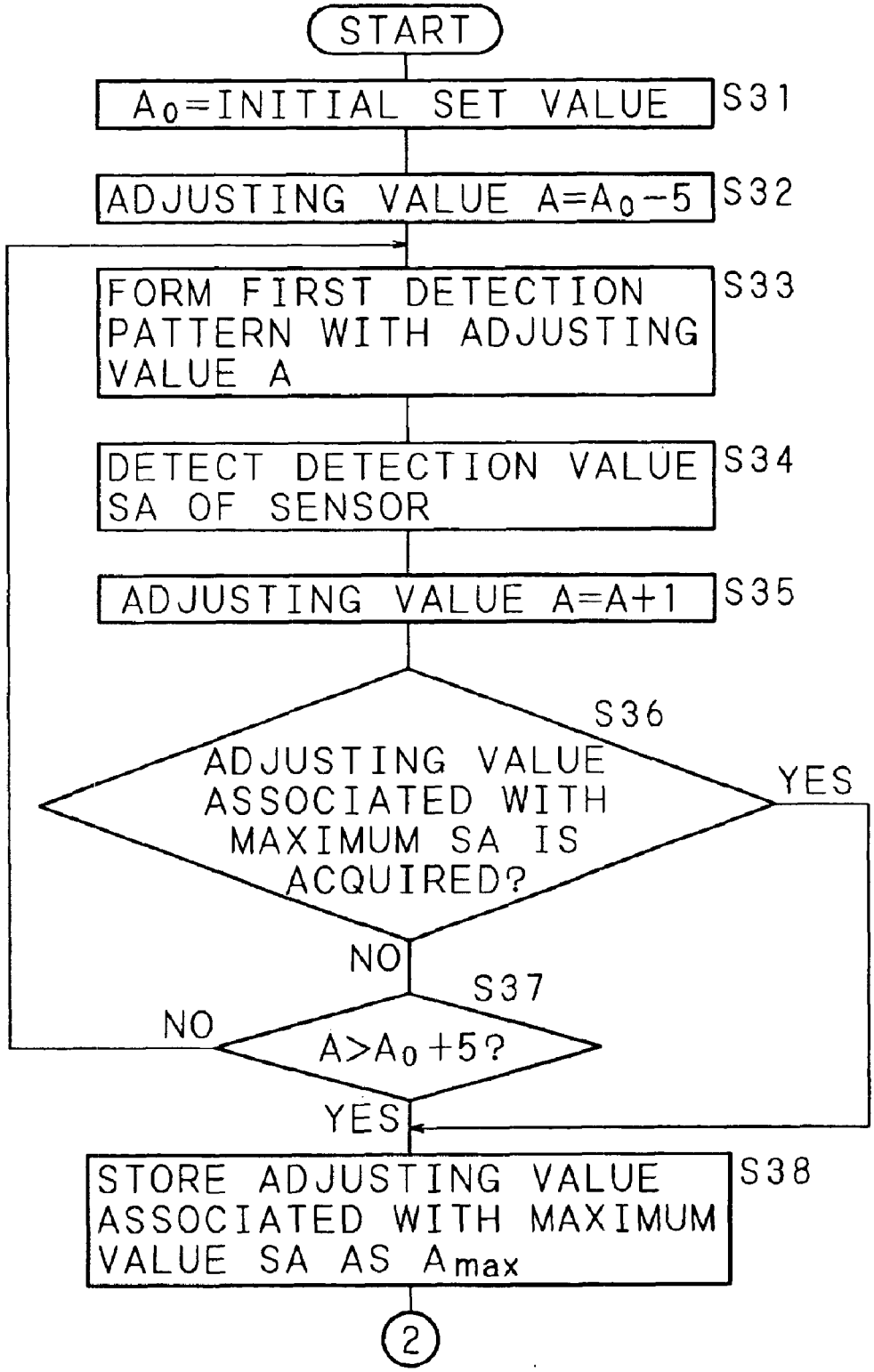
FIG. 14 is a flowchart for explaining the steps of the color matching adjustment process according to an embodiment of the invention.
Figure 15:
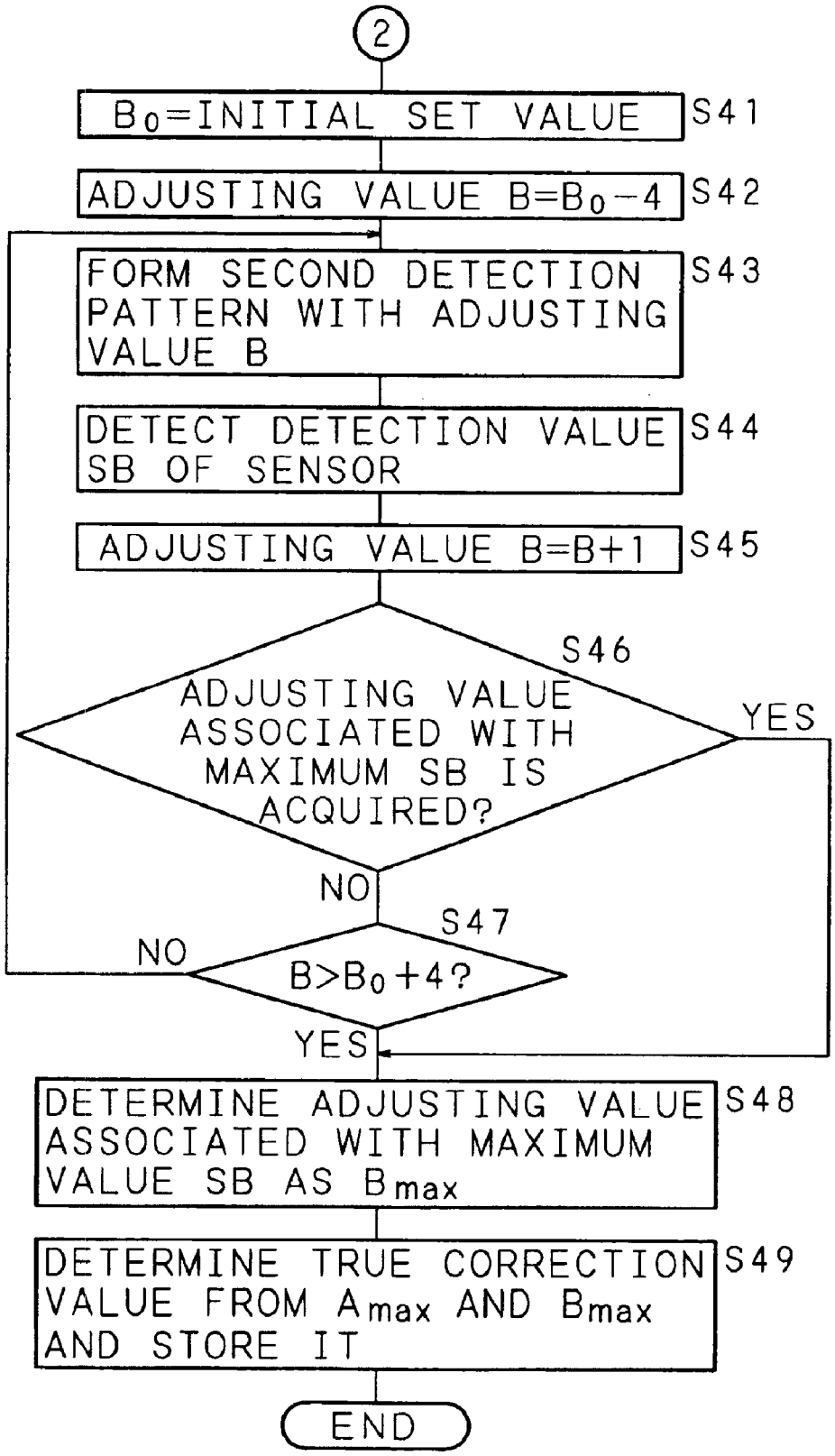
FIG. 15 is a flowchart for explaining the steps of the color matching adjustment process according to an embodiment of the invention.

FIGS. 14 and 15 are flowcharts for explaining the steps of the color matching adjustment process according to this embodiment. Also according to this embodiment, the color matching adjustment range is set to 101 dots, and the color matching adjustment is conducted using the first and second detection patterns explained with reference to the first embodiment. In the flowcharts of FIGS. 14 and 15, the color matching adjustment using the first detection pattern is explained with reference to steps S31 to S38, and the color matching adjustment using the second detection pattern with reference to steps S41 to S48.

First, the control unit 40 of the image forming apparatus 100 determines an arbitrary position in the color matching adjustment range as an initial set value (A0) (step S31), and determines an adjusting value A equal to the initial set value A0 less 5 as a measurement starting point of the registration detecting sensor 21 (step S32). Specifically, a position 5 dots off from the position corresponding to the initial set value A0 is determined as a measurement starting point. Then, the control unit 40 controls the exposure timing for the correction lines by the adjusting value A thereby to form the first detection pattern on the transfer belt 7 (step S33).

Next, in order to measure the average concentration value of the first detection pattern formed on the transfer belt 7, the detection value SA of the sensor (registration detecting sensor 21) is detected (step S34), and after incrementing the adjusting value by 1 (step S35), it is judged whether an adjusting value associated with a maximum detection value SA has been acquired or not (step S36). In order to judge whether the detection value SA becomes maximum in the midst of the measurement area, it is necessary to measure the average concentration value within the particular measurement area in advance and to determine the maximum detection value. Based on the detection value thus determined, a threshold value is set, and it is judged whether the detection value detected by the color matching adjustment process is larger than the threshold value or not. In this way, it is judged whether the detection value SA becomes maximum or not.

In the case where an adjusting value associated with the maximum detection value SA is not acquired (NO in S36), the control unit 40 judges whether the adjusting value A is larger than A0+5 or not (step S37) thereby to judge whether the process is still in the measurement area or not. In the case where it is judged that the current adjusting value A is not more than A0+5 (NO in step S37), the process is returned to step S33. In the case where it is judged in step S36 that an adjusting value associated with the maximum detection value SA has been acquired (YES in S36) or in the case where A is increased beyond A0+5 (YES in S37), the adjusting value associated with the maximum detection value SA is stored as Amax (step S38). At the same time, an adjusting value at which the detection value of the registration detecting sensor 21 becomes maximum outside the measurement range can be predicted as a value equal to Amax plus an integer multiple of 11.

Next, the color matching adjustment process using the second detection pattern is explained. Though different in the range of the measurement area, the process is basically similar to the color matching adjustment using the first detection pattern. First, the control unit 40 sets the initial set value B0 as an adjusting value constituting the center of the measurement area (step S41). The adjusting value B equal to the initial set value B0 less 4 is set as a measurement starting point of the registration detecting sensor 21 (step S42). Then, the control unit 40 controls the exposure timing for the correction lines with the adjusting value B thereby to form the second detection pattern on the transfer belt 7 (step S43). In order to measure the average concentration value of the second detection pattern formed on the transfer belt 7, the detection value SB of the sensor (the registration detecting sensor 21) is detected (step S44). After incrementing the adjusting value B by 1 (step S45), the control unit 40 judges whether an adjusting value associated with the maximum detection value SB has been acquired or not (step S46).

In the case where it is determined that an adjusting value associated with the maximum detection value SB has not been acquired (NO in S46), the control unit 40 judges whether the adjusting value B is larger than B0+4 or not (step S47) and whether the current process is out of the measurement area or not. In the case where it is judged that current adjusting value B is not more than B0+4 (NO in S47), i.e. that the current process is still in the measurement area, the process is returned to step S43, and until the adjusting value B deviates out of the measurement area, the image forming position of the correction lines is shifted by one dot each time while repeatedly detecting the average concentration value.

In the case where it is judged in step S46 that an adjusting value associated with the maximum detection value SB has been acquired (YES in S46) or that the adjusting value B has increased beyond B0+4 (YES in S47), the adjusting value associated with the maximum detection value SB is stored as Bmax (step S48). Then, the control unit 40 determines the true correction value from Amax and Bmax in store and stores the correction value in the storage unit 44 (step S49). The true correction value can be determined in the following manner: First, a first candidate in the color matching adjustment range is acquired from Amax stored in step S38, plus a value i times (i=0, ±1, ±2, . . . ) as large as 11, and a second candidate in the color matching adjustment range is acquired from Bmax stored in step S48, plus a value j times ( j=0, ±1, ±2, . . . ) as large as 9. By finding out an adjusting value at which the first candidate and the second candidate are coincident with each other, the true correction value is determined.

(Third Embodiment)

In the embodiments described above, the color matching adjustment is conducted always with the second detection pattern after the color matching adjustment with the first detection pattern. Nevertheless, the color matching adjustment with the second detection pattern may be omitted. Assume that the color matching adjustment is to be conducted always after power is turned on, and that the image forming apparatus is often used. Then, since the color matching adjustment has been conducted many times, no large color misregistration is expected to occur, and therefore the color matching adjustment with the second detection pattern may be done without.

Figure 16:
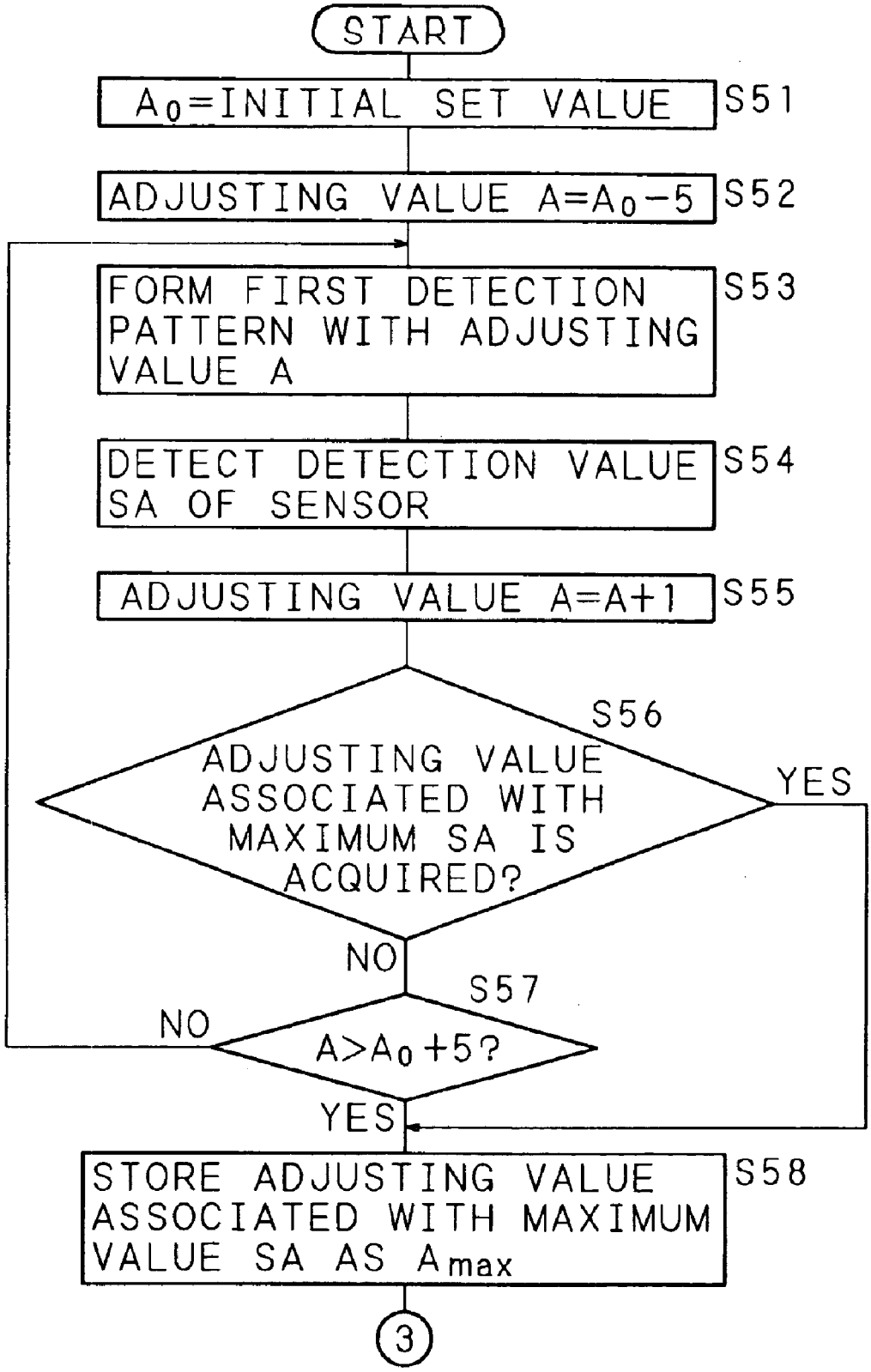
FIG. 16 is a flowchart for explaining the steps of the color matching adjustment process according to an embodiment of the invention.
Figure 17:
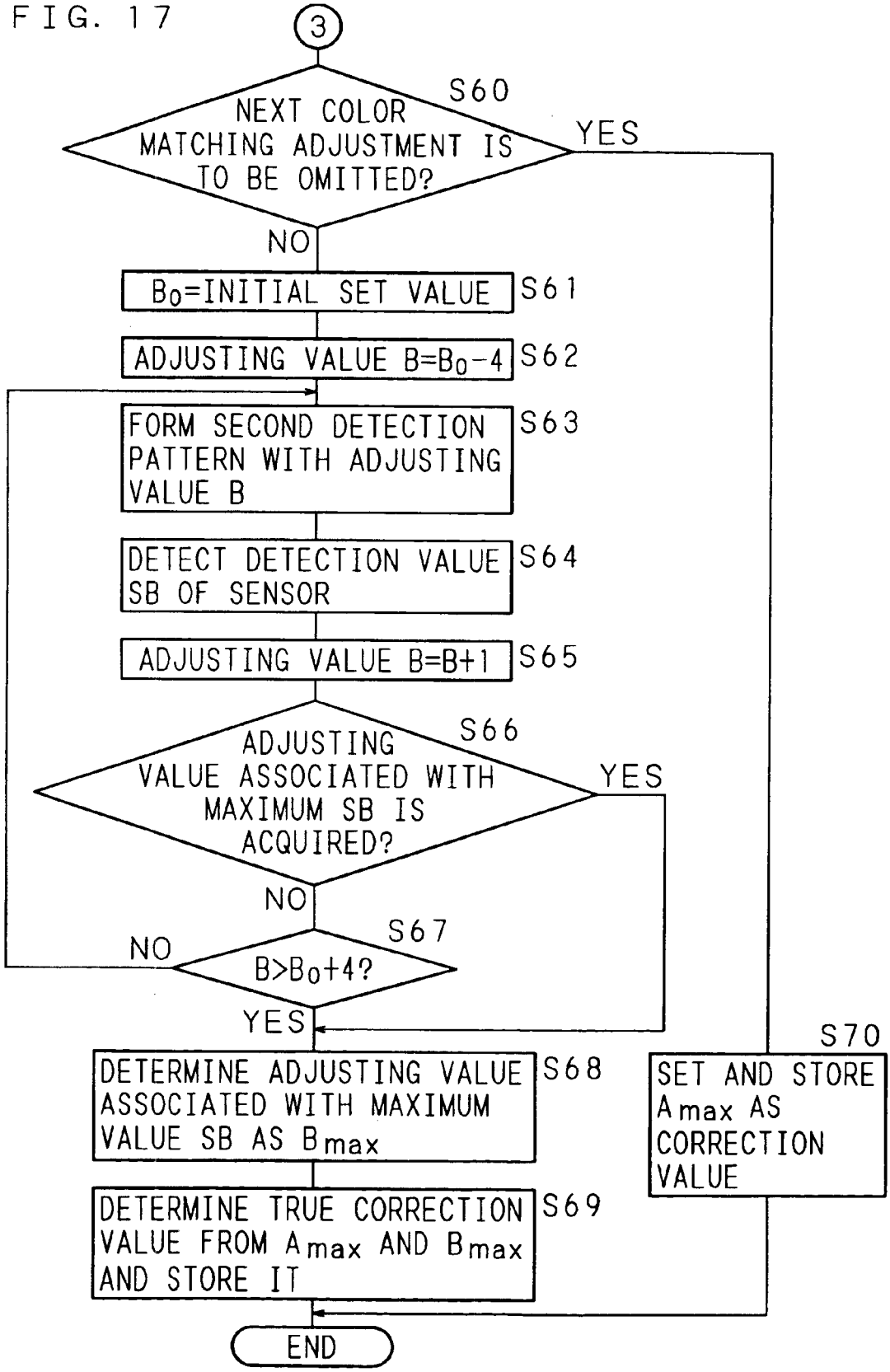
FIG. 17 is a flowchart for explaining the steps of the color matching adjustment process according to an embodiment of the invention.

FIGS. 16 and 17 are flowcharts for explaining the steps of the color matching adjustment process according to this embodiment. Also in this embodiment, the color matching adjustment range is set to 101 dots, and the color matching adjustment is conducted using the first detection pattern and the second detection pattern explained above in the first embodiment. In the flowcharts shown, steps S51 to S58 are for the color matching adjustment with the first detection pattern, and steps S60 to S68 are for the color matching adjustment with the second detection pattern. The process up to steps S51 to S58 is exactly identical to the process up to steps S31 to S38 in the flowchart according to the second embodiment, and is not explained again.

Once the color matching adjustment using the first detection pattern is finished (step S58), it is judged whether the next color matching adjustment with the second detection pattern is to be omitted or not (step S60). As described above, in the case where the color matching adjustment is intended always after power is turned on and where the image forming apparatus 100 is often used, the occurrence of a large color misregistration is not predicted. Upon the lapse of a predetermined time after power is first turned on or after a predetermined number of images have been formed, therefore, the resulting indication that the apparatus has been frequently used may lead to the omission of the color matching adjustment with the second detection pattern. In the case where it is judged that the next color matching adjustment is to be omitted (YES in S60), Amax is set as a correction value and stored in the correction value storage unit 44 (step S70). At the time point when the correction value is stored in the correction value storage unit 44, the color matching adjustment according to this flowchart is finished.

In the case where it is judged that the next color matching adjustment cannot be omitted (NO in S60), the color matching adjustment with the second detection pattern is carried out. The color matching process with the second detection pattern up to steps S61 to S68 is exactly the same as that with the process up to steps S41 to S48 in the flowchart of the second embodiment, and therefore is not described again. In the case where an adjusting value associated with the maximum detection value SB is determined (S68), the control unit 40 determines the true correction value from Amax and Bmax in store, and stores it in the correction value storage unit 44 (step S69). The true correction value can be determined in the following manner: First, a first candidate is acquired within the color matching adjustment range from Amax stored in step S58 plus a value i times (i=0, ±1, ±2, . . . ) as large as 11, and a second candidate is acquired within the color matching adjustment range from Bmax stored in step S68 plus a value j times (j=0, ±1, ±2, . . . ) as large as 9. By finding out an adjusting value at which the first and second candidates are coincident with each other, the true correction value is determined.

According to this embodiment, it is judged whether the color matching adjustment with the second detection pattern is to be omitted or not, based on the history of frequency in use of the image forming apparatus 100. Nevertheless, the user can of course judge whether one of the color matching adjustments is to be omitted or not. Upon completion of the color matching adjustment with the first detection pattern, for example, assume that the possibility of omitting the next color matching adjustment is notified and a predetermined key operation of the operating unit 48, etc. is received. Then, the particular color matching adjustment may be omitted.

(Fourth Embodiment)

An explanation is given below about a case where a plurality of color components are existent for color matching adjustment. According to this embodiment, the first step is to conduct the color matching adjustment for cyan (C) and then the color matching adjustment for magenta (M) and yellow (Y), in that order. The manner in which the color matching adjustment for the respective color components at the same time is explained later with reference to a fifth embodiment.

Figure 18:
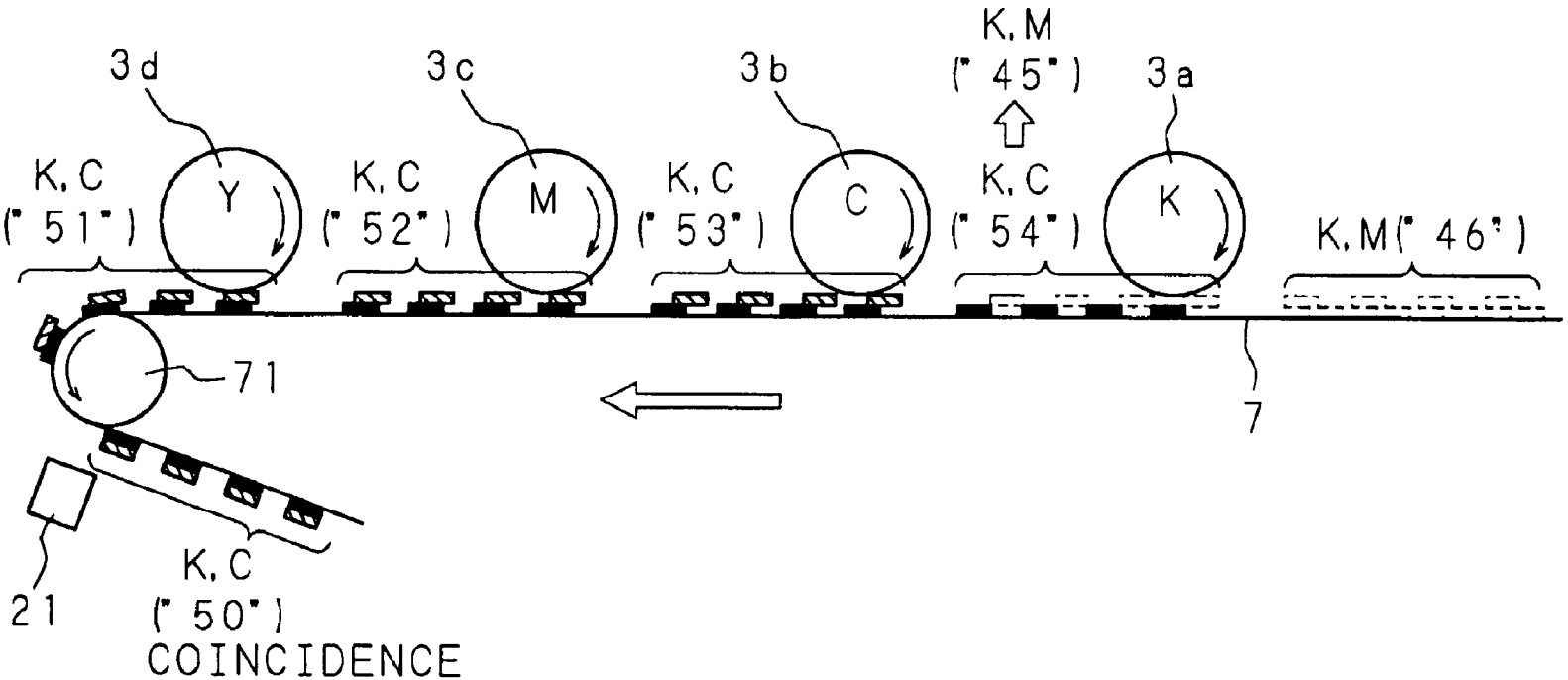
FIG. 18 is a schematic diagram for explaining the color matching adjustment according to an embodiment of the invention.

FIG. 18 is a schematic diagram for explaining the color matching adjustment according to this embodiment. In this embodiment, the color matching adjustment for cyan (C), magenta (M) and yellow (Y) are carried out in that order. In the case where an adjusting value associated with a local maximum average concentration value is determined midway of the measurement area, the image of the particular color component stops being formed, and the color matching adjustment for the next color component is started. In this way, the extraneous labor for forming an image is saved and the amount of the developer reduced.

In the case where the color matching adjustment is conducted in the adjusting value range of "45" to "55" using the first detection pattern, for example, the first step is to start forming the first detection pattern by controlling the exposure timing of the exposure unit 1*b* in order to conduct the color matching adjustment of the black (K) reference lines and the cyan (C) correction lines. While the color matching adjustment is being conducted by repetitively forming the first detection pattern and detecting the average concentration value, assume that it is judged that the reference lines and the correction lines are superposed at the adjusting value "50", for example. The cyan image forming operation is immediately suspended. In the case where the interval is large between the registration detecting sensor 21 and the black (K) photosensitive drum 3*a* as shown in FIG. 18, the correction lines corresponding to the adjusting values "51", "52" and "53" have already been formed in spite of an instruction which may be given by the control unit 40 to stop forming the cyan (C) image at the adjusting value "50". By suspending the cyan (C) image forming operation for and subsequent to the adjusting value "54", however, the amount of the cyan (C) developer can be reduced. Also, instead of forming the cyan (C) image at the adjusting value "54", the next color matching adjustment for magenta (M) is started thereby to form the magenta (M) image at the adjusting value "45". In this way, the adjustment time can be shortened.

Figure 19:
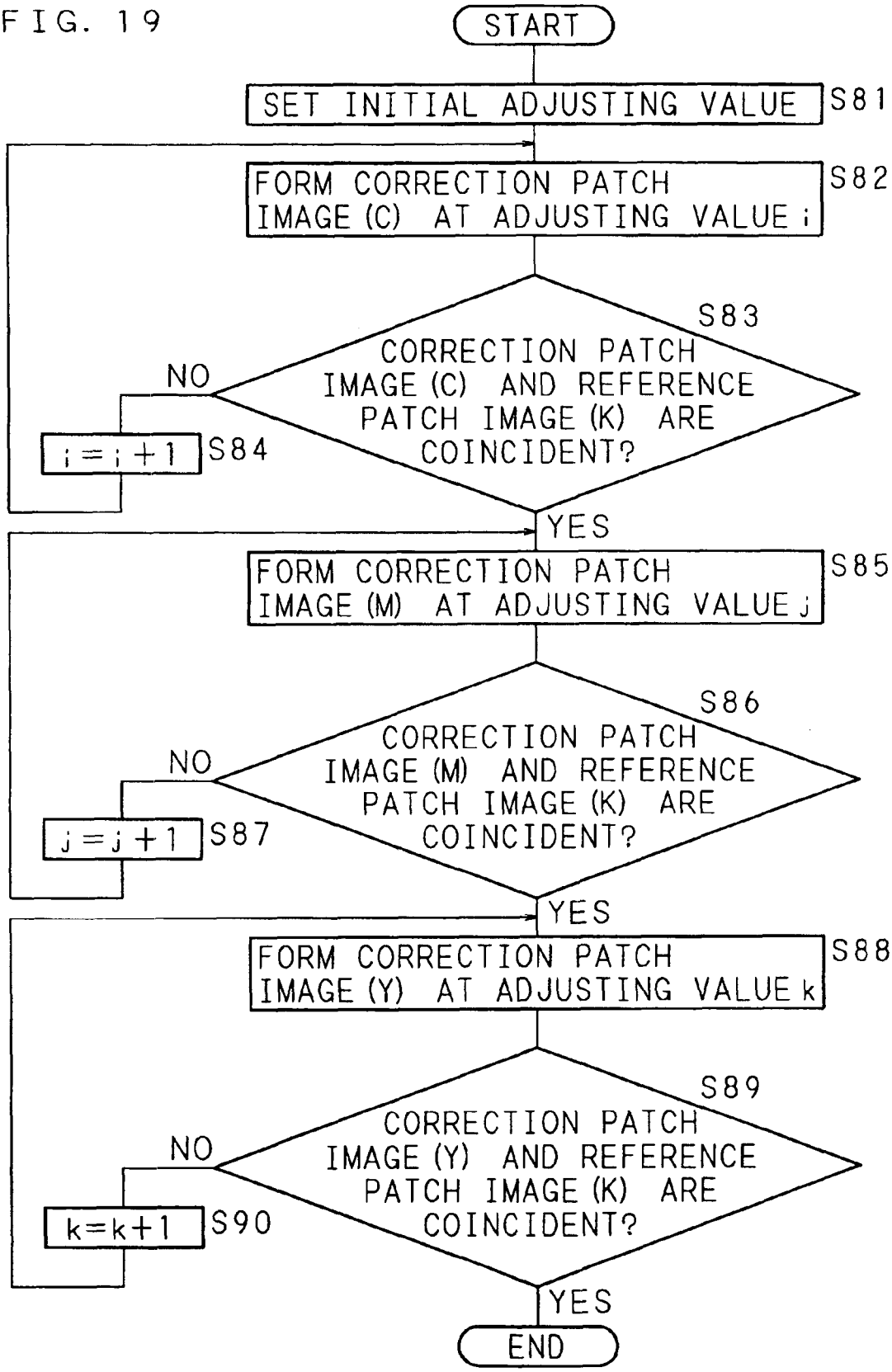
FIG. 19 is a flowchart for explaining the processing steps of the color matching adjustment for a plurality of color components.

FIG. 19 is a flowchart for explaining the processing steps for the color matching adjustment of a plurality of color components. First, the control unit 40 of the image forming apparatus 100 sets the initial adjusting value of the correction lines for the color matching adjustment of each color component (step S81). In the preceding case, for example, the initial adjusting value i of cyan (C) is set to 45, the initial adjusting value j of magenta (M) to 45 and the initial adjusting value k of yellow (Y) to 45.

Then, a correction patch image (C) for cyan is formed at the adjusting value i on a reference patch image (K) (step S82). The control unit 40 then judges whether the reference patch image (K) and the correction patch image (C) have coincided with each other, based on the result of detection by the registration detecting sensor 21 (step S83). The judgement as to whether the reference patch image and the correction patch image are coincident with each other or not is made by judging, for example, whether a value detected as the local maximum value of the registration detecting sensor 21 has been obtained or not. In the case where the control unit 40 judges that the reference patch image (K) and the correction patch image (C) fail to coincide with each other (NO in S83), the adjusting value i is incremented by 1 (step S84), and the process is returned to step S82. Thus, the formation of the correction patch image (C) at the adjusting value i and the detection by the registration detecting sensor 21 are repeated.

In the case where the control unit 40 judges in step S83 that the reference patch image (K) and the correction patch image (C) are coincident with each other (YES in S83), on the other hand, the correction patch image (C) stops being formed, and the correction patch image of magenta (M) is formed on the reference patch image (K) at the adjusting value j (step S85). The control unit 40, based on the result of detection of the registration detecting sensor 21, judges whether the reference patch image (K) and the correction patch image (M) are coincident with each other or not (step S86). In the case where it is judged that the reference patch image (K) and the correction patch image (M) fail to coincide with each other (NO in S86), the adjusting value j is incremented by 1 (step S87), and the process is returned to step S85.

In the case where the control unit 40 judges in step S86 that the reference patch image (K) and the correction patch image (M) are coincident with each other (YES in S86), the correction patch image (M) stops being formed, and a yellow correction patch image (Y) is formed on the reference patch image (K) at the adjusting value k (step S88). Then, the control unit 40 judges, based on the result of detection by the registration detecting sensor 21, whether the reference patch image (K) and the correction patch image (Y) are coincident with each other or not (step S89). In the case where it is judged that the reference patch image (K) and the correction patch image (Y) fail to coincide with each other (NO in S89), the adjusting value k is incremented by 1 (step S90), and the process is returned to step S88. In the case where the control unit 40 judges that the reference patch image (K) and the correction patch image (Y) coincide with each other (YES in S89), on the other hand, the correction patch image (Y) stops being formed thereby to terminate the color matching adjustment process. The color matching adjustment with the first detection pattern explained with reference to FIG. 19 may be followed by the color matching adjustment with the second detection pattern after step S89.

(Fifth Embodiment)

In the color matching adjustment explained in the fourth embodiment, after the color matching adjustment for a given color component, the color matching adjustment for each of other color components is continued. In order to further reduce the amount of the developer and the time required, however, the color matching adjustment for a plurality of color components are carried at the same time. The simultaneous color matching adjustment for the color components of cyan (C), magenta (M) and yellow (Y) is explained below.

Figure 20:
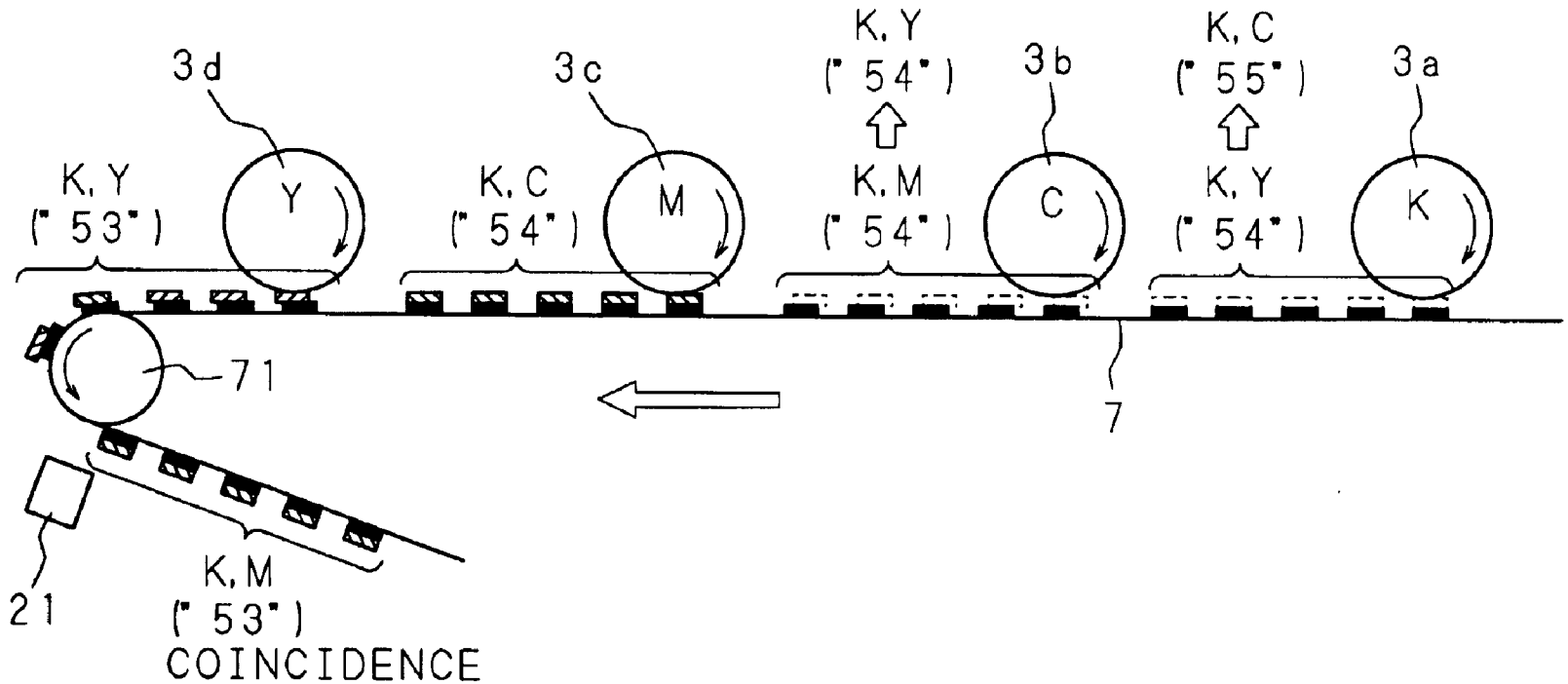
FIG. 20 is a diagram for explaining an example of the image forming process executed for the color matching adjustment of a plurality of color components.

FIG. 20 is a diagram for explaining an example of the image forming process in the case where the color matching adjustment is carried out for a plurality of color components. In the color matching adjustment according to this embodiment, a cyan correction patch image is formed at the adjusting value "45", after which a magenta correction patch is formed on the same condition at the adjusting value "45", further followed by forming a yellow correction patch image at the adjusting value "45". The color matching adjustment is conducted while changing the adjusting value sequentially. The color matching adjustment for a plurality of color components are carried out at the same time in this way. In the case where the magenta correction patch image and the reference image are found to be coincident with each other at the adjusting value of "53", as shown in FIG. 20, for example, the magenta correction patch image immediately stops being formed. By doing so, the magenta correction patch image need not be formed at the adjusting value "54", thereby preventing the correction patch image from being wastefully formed. The yellow correction patch image may be formed at the adjusting value "54" instead of the magenta correction patch image at the adjusting value "54". In this case, the consumption of the developer is further reduced and the entire color matching process is finished within a shorter length of time.

Figure 21:
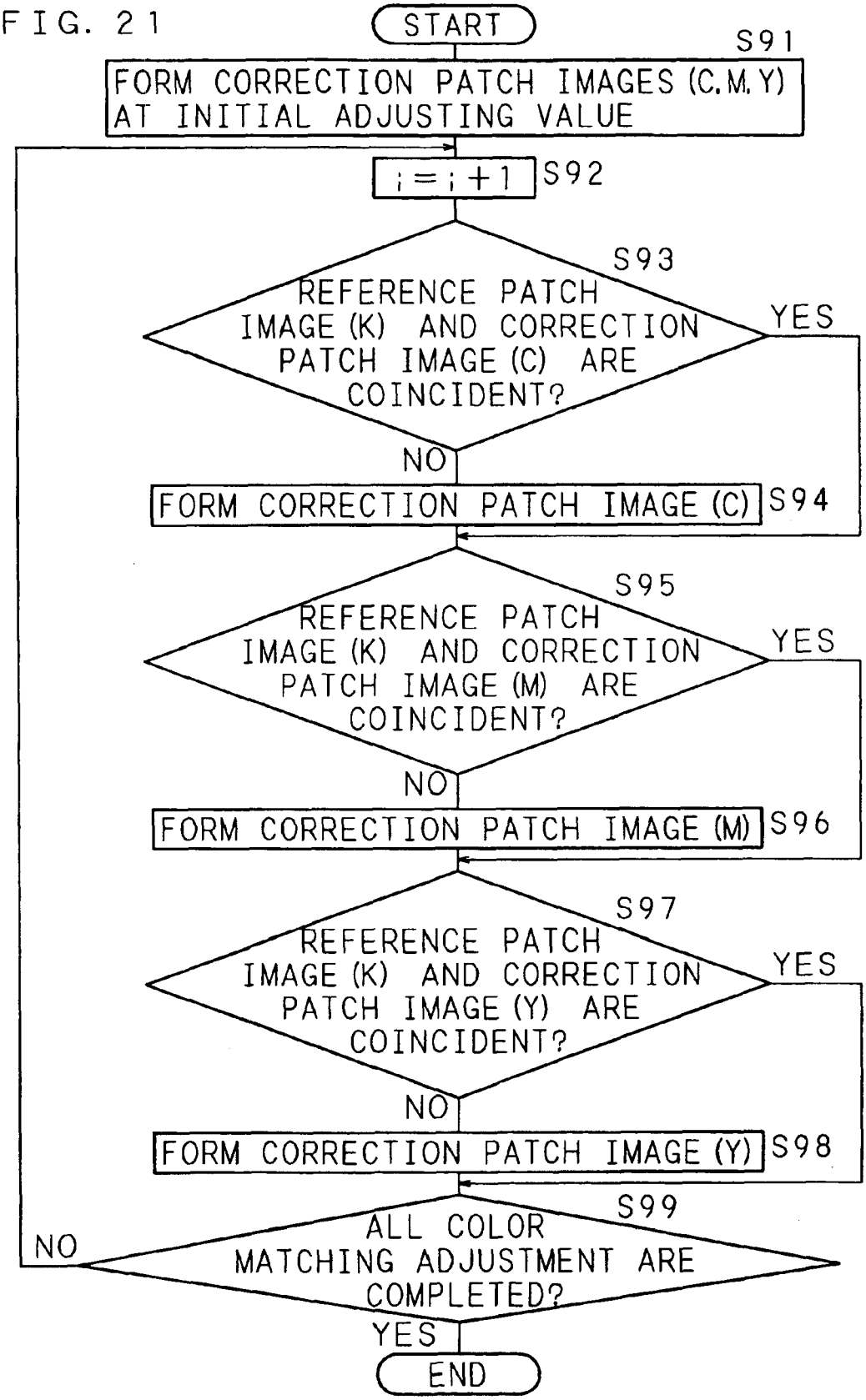
FIG. 21 is a flowchart for explaining the processing steps of the color matching adjustment for a plurality of color components.

FIG. 21 is a flowchart for explaining the processing steps for color matching adjustment carried out for a plurality of color components. First, the control unit 40 sets the initial adjusting value i corresponding to the image forming position of each correction patch image (C, M, Y) i, and forms the correction patch images (C, M, Y) at the initial adjusting value i thus set (step S91). In the case of the color matching adjustment with the first detection pattern, the initial adjusting value of each of the correction patch images (C, M, Y) is set to "45" thereby to start forming an image.

Then, the control unit 40 increments the adjusting value i by 1 (step S92), and by referring to the result of detection by the registration detecting sensor 21, judges whether the reference patch image (K) and the correction patch image (C) are coincident with each other (step S93). The judgement as to whether the reference patch image and the correction patch image are coincident with each other is made by judging whether the detection value of the registration detecting sensor 21 is a local maximum or not.

In the case where it is judged that the reference patch image (K) and the correction patch image (C) fail to be coincident with each other (NO in S93), the correction patch image (C) is formed at the adjusting value i (step S94). In the case where it is judged that the reference patch image (K) and the correction patch image (C) are coincident with each other (YES in S93), on the other hand, the correction patch image (C) stops being formed and it is judged whether the reference patch image (K) and the magenta correction patch image (M) are coincident with each other (step S95). In the case where it is judged that the reference patch image (K) and the correction patch image (M) are not coincident with each other (NO in S95), the correction patch image (M) is formed at the adjusting value i (step S96). In the case where it is judged that the reference patch image (K) and the correction patch image (M) are coincident with each other (YES in S95), on the other hand, the correction patch image (M) stops being formed and it is judged whether the reference patch image (K) and the yellow correction patch image (Y) are coincident with each other (step S97).

In the case where it is judged that the reference patch image (K) and the correction patch image (Y) fail to be coincident with each other (NO in S97), the correction patch image (Y) is formed at the adjusting value i (step S98), and then the next process is executed. Also, in the case where it is judged that the reference patch image (K) and the correction patch image (Y) are coincident with each other (YES in S97), on the other hand, the next process is executed without executing the process of step S98. Once the superposed relation of the correction patch images (C, M, Y) is completely detected at the adjusting value i, it is judged whether the color matching adjustment is completed or not with all the correction patch images (C, M, Y) of the respective color components coinciding with the reference patch image (K) (step S99). In the case where it is judged that the color matching adjustment has yet to be completed (NO in S99), the process returns to step S92, and after updating the adjusting value i, the color matching adjustment is continued. In the case where it is judged in step S99 that the color matching adjustment is complete (YES in S99), the routine is finished.

As described above, according to this embodiment, in the case where the color matching adjustment of a given color component is finished, the correction patch image of other color component is immediately formed. Thus, the image is formed less wastefully, thereby effectively contributing to a reduced amount of the developer consumed and a shorter adjustment time.

(Sixth Embodiment)

In the case where the image forming apparatus 100 is connected with an information processing system such as a personal computer through LAN, the computer program for executing the color matching adjustment process described above is installed in the information processing system and thus the color matching adjustment can be carried out in response to an instruction from the information processing system.

Figure 22:
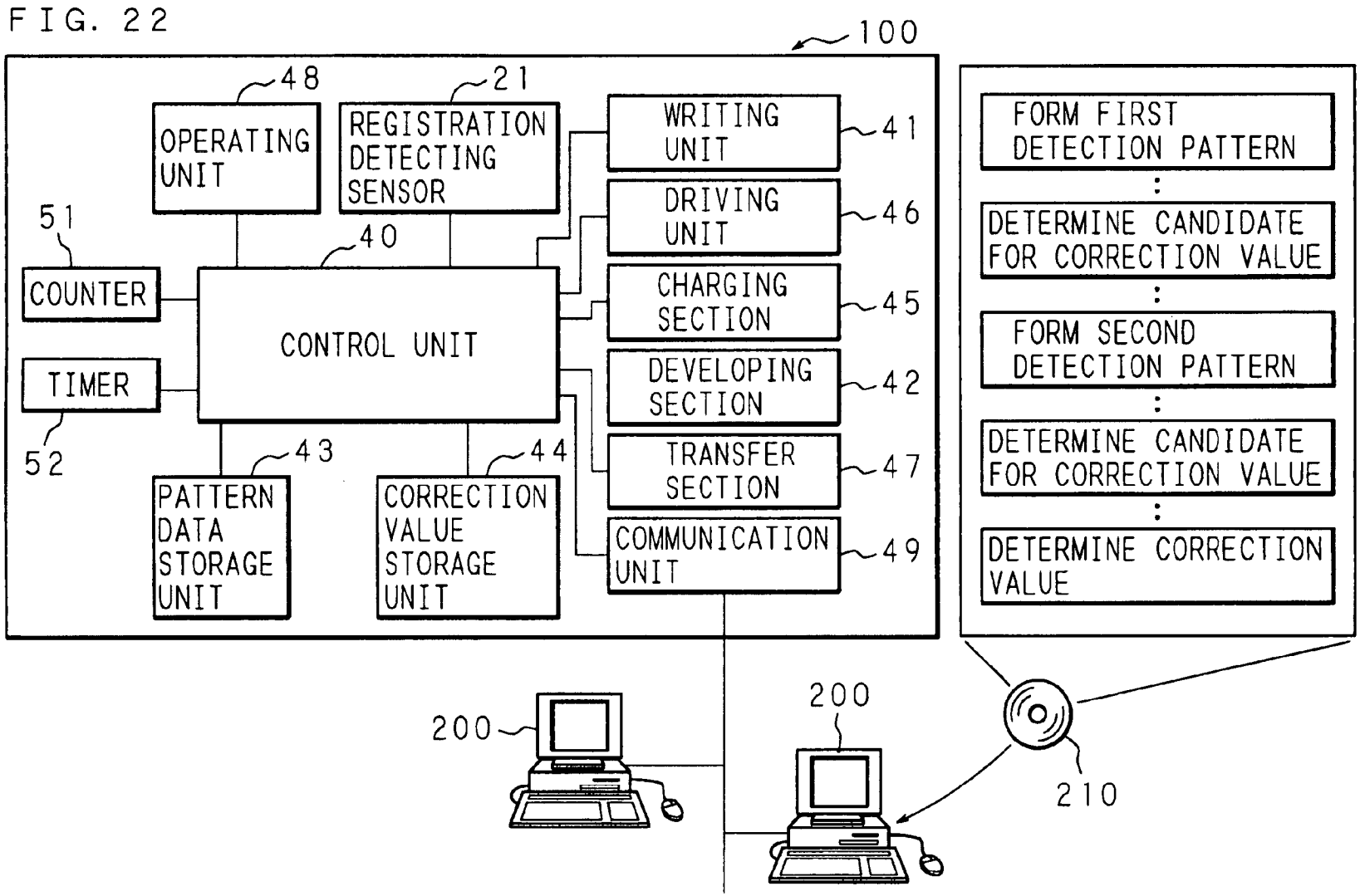
FIG. 22 is a block diagram showing an example of the connection of an image forming apparatus according to an embodiment of the invention.

FIG. 22 is a block diagram showing an example of connection of the image forming apparatus 100 according to this embodiment. The image forming apparatus 100 includes a control unit 40 configured of a CPU, and the control unit 40 is connected with the hardware equipment required for color matching adjustment such as a registration detecting sensor 21, a writing unit 41, a developing section 42, a charging section 45, a driving unit 46, a transfer section 47, a pattern data storage unit 43 and a correction value storage unit 44. The image forming apparatus 100 also includes a communication unit 49 connected to the control unit 40, and connected through the communication unit 49 to external information processing systems 200, 200, . . . . The communication unit 49 receives various jobs including the print job and the facsimile job transmitted from the information processing system 200, and after developing them into a form executable by the control unit 40, sends the jobs to the control unit 40. The control unit 40 that has received the jobs executes the image forming process or the like in accordance with each of the jobs.

The information processing system 200 has installed therein a computer program according to the invention supplied in the form of a memory product 210 such as an FD or a CD-ROM, and the color matching process can be conducted by the image forming apparatus 100. The process which the information processing system 200 causes the image forming apparatus 100 to execute includes the process of forming a first detection pattern, the process of detecting the image concentration of the first detection pattern by the registration detecting sensor 21 and acquiring a candidate for the correction value, the process of forming a second detection pattern, the process of detecting the image concentration of the second detection pattern by the registration detecting sensor 21 and acquiring a candidate for the correction value, and the process of determining the correction value. The process executed by the image forming apparatus 100 is exactly the same as that described above, and is not described below. Also, the computer program according to this invention may of course be supplied by communication through the Internet or the like instead of in the form of the memory product such as an FD or a CD-ROM.

As described above in detail, according to this invention, a superposed state is detected by use of two sets of images including a reference image and a correction image having different pitches, and an adjusting value is determined in such a manner that the candidate for the adjusting value obtained by the color matching adjustment with one pitch is coincident with the candidate for adjusting value obtained by the color matching adjustment with the other pitch. In this way, an optimum adjusting value is determined with two different pitches, and therefore an adjusting value can be determined at which all the reference images and the adjustment images in an image forming area are accurately superposed, thereby making it possible to conduct the color matching adjustment with high accuracy. Also, in the case where the reference image and the adjustment image with the image forming position having a periodicity are used, a candidate for an adjusting value acquired from a comparatively narrow range can be used to predict a candidate outside the aforementioned range. Thus, the time required for color matching adjustment is reduced while at the same time reducing the amount of the developer consumed.

According to this invention, the adjustment image forming position is shifted sequentially with respect to the reference image, so that the concentration within the image forming area is detected while conducting the color matching adjustment. It is judged that the two sets of images are superposed in the case where the detected concentration assumes a local maximum value, for example. An adjusting value associated with this state can be used as one candidate to be acquired.

According to this embodiment, the color matching adjustment is conducted using two sets of images including a reference image and an adjustment image having different pitches. Thus, an adjusting value is acquired in such a manner that the two types of adjustment images having different pitches are superposed. Therefore, as compared with a case in which the color matching adjustment is conducted using a reference image and an adjustment image, the color matching adjustment in an image forming area can be conducted with high accuracy.

According to this invention, a position spaced by an integer multiple of the image forming interval from the position where the two images are superposed can be acquired as a candidate for an adjusting value. Therefore, another candidate can be easily determined by an arithmetic operation from the candidates for the adjusting value acquired in the detection area.

According to this invention, the detection of the superposition of one set of the reference image and the adjustment image can be omitted. In the case where the color matching adjustment is to be conducted before forming an image after switching on power for the image forming apparatus, therefore, the non-occurrence of a large color misregistration can be predicted upon the lapse of a predetermined time after switching on power or when more than a predetermined number of images are formed. Thus, the color matching adjustment can be conducted using one of the sets of the reference image and the adjustment image, while omitting the color matching adjustment using the other set of the reference image and the adjustment image. By thus omitting the color matching adjustment for one of the image sets, the amount of the developer and the length of the adjustment time can be reduced.

According to this invention, in the case where an adjustment image and a reference image for one color component are superposed, it is judged whether the superposed state of an adjustment image for other color component is to be detected or not. Only in the case where it is judged that such a superposed state is to be detected, the particular adjustment image is formed. In place of the adjustment image for a given color component for which the superposed state with the reference image is detected, therefore, an adjustment image for other color component is formed. Therefore, the time required for adjusting each color component image can be shortened. Also, since only the adjustment image of a specific color component is omitted, the amount of the developer for the particular color component is reduced.

According to this invention, in the case where the superposed state is obtained for the adjustment images of all the color components, the reference color component image stops being formed. Thus, the invention has the advantages that both the amount of the developer used and the time consumed for adjustment are reduced.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image adjusting method for adjusting the image forming position of each color component image so that a plurality of color component images are superposed, comprising:

a first step of forming a reference image of one color component;

a second step of forming an adjustment image of other color component on the reference image in accordance with an adjusting value for a predetermined image forming position;

a third step of detecting a superposed state of the reference image and the adjustment image thus formed;

a fourth step of repeating the process of said first to third steps while changing the adjusting value sequentially within a predetermined range;

a fifth step of acquiring a first candidate for the adjusting value for the image forming position where the two images are superposed, based on the result of detection in said third step;

a sixth step of acquiring a second candidate for the adjusting value for the image forming position where the two images are superposed, after executing the process of said first to fourth steps using a reference image and an adjustment image different from the reference image and the adjustment image, respectively; and a seventh step of acquiring an adjusting value for the image forming position of the adjustment image based on the first and second candidates thus acquired.

2. The image adjusting method according to claim 1, wherein the reference image and the adjustment image are both an image having a predetermined shape, and the interval between the adjustment images for acquiring the first candidate is differentiated from the interval between the adjustment images for acquiring the second candidate to form the adjustment images on the reference image.

3. An image forming apparatus for forming an image by superposing a plurality of color component images, comprising:

a first image forming unit for forming a reference image of one color component;

a storage unit for storing an adjusting value for an image forming position;

changing unit for changing the adjusting value stored;

a second image forming unit for forming an adjustment image of other color component on the reference image in accordance with the adjusting value sequentially changed within a predetermined range;

a detection unit for detecting a superposed state of the reference image and the adjustment image thus formed;

a candidate acquisition unit for acquiring a plurality of candidates for the adjusting values for an image forming position where the two images are superposed, based on said detection result of the detection unit, and acquiring two candidates for adjusting value using different two sets of the reference image and the adjustment image; and a determining unit for determining an adjusting value from the two candidates thus acquired.

4. The image forming apparatus according to claim 3, wherein said detection unit is a measuring unit for measuring the concentration of an image forming area.

5. The image forming apparatus according to claim 3, wherein the reference image and the adjustment image of each set have a predetermined shape, the apparatus further comprising an interval storage unit for storing an image forming interval of forming the adjustment images of the respective sets, and in accordance with the image forming interval stored in said interval storage unit, an adjustment image is formed.

6. The image forming apparatus according to claim 5, wherein the candidate for the adjusting value to be acquired is an adjusting value corresponding to a position spaced by an integer multiple of the image forming interval from the image forming position of the adjustment image with the two images superposed.

7. The image forming apparatus according to claim 3, further comprising a reception unit for receiving an instruction to omit the detection of the superposed state using one of the two sets of the reference images and the adjustment images, wherein upon receipt of the instruction, the reference image and the adjustment image stop being formed.

8. The image forming apparatus according to claim 3 further comprising a judging unit for judging, upon detection of the superposed state of an adjustment image and a reference image of one color component, whether the superposed state of an adjustment image and a reference image of other color component is to be detected or not, wherein upon judgement that such detection is required, the adjustment image is formed on the reference image.

9. The image forming apparatus according to claim 3, further comprising a suspending unit for suspending the formation of a new reference image and a new adjustment image upon detection of the superposed state of the adjustment images of all the color components to be detected.

10. A memory product for recording a computer program for causing a computer to adjust the image forming position of each color component image so that a plurality of color component images are superposed, the computer program comprising:

a first step of causing the computer to form a reference image of one color component;

a second step of causing the computer to form an adjustment image of other color component on the reference image in accordance with an adjusting value for a predetermined image forming position;

a third step of causing the computer to detect a superposed state of the reference image and the adjustment image thus formed;

a fourth step of causing the computer to repeat the process of said first to third steps while changing the adjusting value sequentially within a predetermined range;

a fifth step of causing the computer to acquire a first candidate for the adjusting value for the image forming position where the two images are superposed, based on the result of detection in said third step;

a sixth step of causing the computer to acquire a second candidate for the adjusting value for the image forming position where the two images are superposed, after executing the process of said first to fourth steps using a reference image and an adjustment image different from the reference image and the adjustment image, respectively; and a seventh step of causing the computer to determine an adjusting value for the image forming position of the adjustment image based on the first and second candidates thus acquired.

* * * * *